US011873457B2

(12) United States Patent
Bai et al.

(10) Patent No.: US 11,873,457 B2
(45) Date of Patent: Jan. 16, 2024

(54) CATALYTIC CONVERSION PROCESS AND SYSTEM FOR PRODUCING GASOLINE AND PROPYLENE

(71) Applicants: CHINA PETROLEUM & CHEMICAL CORPORATION, Beijing (CN); RESEARCH INSTITUTE OF PETROLEUM PROCESSING, SINOPEC, Beijing (CN)

(72) Inventors: Xuhui Bai, Beijing (CN); Yanfen Zuo, Beijing (CN); Youhao Xu, Beijing (CN); Yibin Luo, Beijing (CN); Xingtian Shu, Beijing (CN); Xieqing Wang, Beijing (CN); Xin Wang, Beijing (CN)

(73) Assignees: CHINA PETROLEUM & CHEMICAL CORPORATION, Beijing (CN); RESEARCH INSTITUTE OF PETROLEUM PROCESSING, SINOPEC, Beijing (CN)

( * ) Notice: Subject to any disclaimer, the term of this patent is extended or adjusted under 35 U.S.C. 154(b) by 13 days.

(21) Appl. No.: 17/442,055

(22) PCT Filed: Mar. 17, 2020

(86) PCT No.: PCT/CN2020/079666

§ 371 (c)(1),
(2) Date: Sep. 22, 2021

(87) PCT Pub. No.: WO2020/192491

PCT Pub. Date: Oct. 1, 2020

(65) Prior Publication Data

US 2022/0169930 A1 Jun. 2, 2022

(30) Foreign Application Priority Data

Mar. 22, 2019 (CN) ..... 201910224120.2

(51) Int. Cl.
*C10G 69/12* (2006.01)
*C10G 11/05* (2006.01)
(Continued)

(52) U.S. Cl.
CPC ..... *C10G 69/126* (2013.01); *C10G 11/05* (2013.01); *C10G 11/18* (2013.01); *C10G 45/54* (2013.01);
(Continued)

(58) Field of Classification Search
CPC ..... C10G 55/06; C10G 57/00; C10G 69/00; C10G 69/04; C10G 2300/70;
(Continued)

(56) References Cited

U.S. PATENT DOCUMENTS 3,702,886 A 11/1972 Argauer et al.
5,232,675 A 8/1993 Shu et al.
(Continued)

FOREIGN PATENT DOCUMENTS

CN 1299403 A 6/2001
CN 1078094 C 1/2002
(Continued)

*Primary Examiner* — Brian A McCaig
(74) *Attorney, Agent, or Firm* — NKL Law; Allen Xue

(57) ABSTRACT

A catalytic conversion process for producing gasoline and propylene includes the steps of 1) subjecting a feedstock oil to a first catalytic conversion reaction in a first catalytic conversion reaction device to obtain a first reaction product; 2) separating the first reaction product to obtain a propylene fraction, a gasoline fraction and a fraction comprising $C_4$ olefin; 3) carrying out an oligomerization reaction on the fraction comprising $C_4$ olefin in an oligomerization reactor
(Continued)

to obtain an oligomerization product comprising $C_{12}$ olefin, and optionally separating the oligomerization product to obtain a fraction comprising $C_{12}$ olefin; 4) recycling the $C_{12}$ olefin-containing oligomerization product or fraction to the first catalytic conversion reaction device, and/or sending the $C_{12}$ olefin-containing oligomerization product or fraction to a second catalytic conversion reaction device for a second catalytic conversion reaction to obtain a second reaction product comprising propylene.

13 Claims, 4 Drawing Sheets

(51) Int. Cl.
*C10G 11/18* (2006.01)
*C10G 45/54* (2006.01)
*C10G 50/00* (2006.01)
*C10G 57/02* (2006.01)

(52) U.S. Cl.
CPC ..... *C10G 50/00* (2013.01); *C10G 57/02* (2013.01); *C10G 2300/4006* (2013.01); *C10G 2300/4012* (2013.01); *C10G 2300/4018* (2013.01); *C10G 2300/4025* (2013.01); *C10G 2300/4081* (2013.01); *C10G 2300/70* (2013.01); *C10G 2400/02* (2013.01); *C10G 2400/20* (2013.01)

(58) Field of Classification Search
CPC ..... C10G 2400/00; C10G 2400/04; C10G 2400/20; C07C 4/06; C07C 11/06; C07C 2523/78; C07C 2523/83; C07C 2523/847
See application file for complete search history.

(56) References Cited

U.S. PATENT DOCUMENTS

| | | | | |
|---|---|---|---|---|
| 7,261,807 | B2 | 8/2007 | Henry et al. | |
| 7,678,342 | B1 * | 3/2010 | Xu | C10G 11/18 422/142 |
| 9,834,492 | B2 | 12/2017 | Nicholas et al. | |
| 11,072,751 | B1 * | 7/2021 | Koseoglu | C10G 65/08 |
| 2013/0001129 | A1 * | 1/2013 | Xu | C10G 45/12 208/68 |
| 2014/0135545 | A1 | 5/2014 | Wegerer et al. | |
| 2014/0135557 | A1 | 5/2014 | Nicholas | |
| 2015/0376515 | A1 | 12/2015 | Lim et al. | |
| 2018/0050969 | A1 | 2/2018 | Bhuyan et al. | |

FOREIGN PATENT DOCUMENTS

| | | | |
|---|---|---|---|
| CN | 1912065 | A | 2/2007 |
| CN | 1923971 | A | 3/2007 |
| CN | 102531824 | A | 7/2012 |
| CN | 103131463 | A | 6/2013 |
| CN | 103827263 | A | 5/2014 |
| CN | 101932672 | B | 1/2015 |
| CN | 104560187 | A | 4/2015 |
| CN | 107286972 | A | 10/2017 |
| CN | 109280561 | A | 1/2019 |
| WO | 2010023369 | A1 | 3/2010 |

* cited by examiner

CATALYTIC CONVERSION PROCESS AND SYSTEM FOR PRODUCING GASOLINE AND PROPYLENE

CROSS REFERENCE TO RELATED APPLICATIONS

The present application is a U.S. national stage entry of International Application No. PCT/CN2020/079666, filed Mar. 17, 2020, which claims the priority of Chinese patent application No. 201910224120.2, titled "a process and system for producing gasoline and propylene", filed on Mar. 22, 2019, which is incorporated herein by reference in its entirety.

TECHNICAL FIELD

The present application relates to the field of catalytic conversion of hydrocarbons, particularly to a catalytic conversion process and system for producing gasoline and propylene.

BACKGROUND ART

Propylene is an important chemical raw material, and is an important starting material for producing polypropylene, various important organic chemical materials, synthetic resins and synthetic rubbers, and can also be used for preparing acrylonitrile, isopropanol, phenol, acetone, butanol, octanol, acrylic acid and esters thereof, and preparing chemical products such as propylene oxide, propylene glycol, epichlorohydrin, synthetic glycerin and the like. Propylene is mainly produced by steam cracking devices and catalytic cracking devices, but the potential of increasing the propylene yield by using light oils as a feedstock of steam cracking is limited, and in recent years, this route is increasingly limited by a plurality of restriction factors such as shortage of light feedstock oils, insufficient production capacity, high cost and the like. The catalytic cracking process is a main heavy oil secondary processing technology, and the generation of propylene as a byproduct of catalytic cracking is also an important way for producing propylene, with the production capacity accounting for about one third of the total production capacity of propylene. In catalytic cracking processes, the propylene yield can be regulated by selecting different process modes. Therefore, due to its advantages of wide adaptability for feedstocks, flexible operation and the like, modified catalytic cracking processes with increased propylene yield are rapidly developed in recent years.

Chinese patent application publication No. CN 107286972A discloses a catalytic cracking process for producing propylene in high yield. In this process, a first reactor and a second reactor are provided, so that an independent high-temperature cracking reaction zone and a quick termination of fluidized bed reaction can be realized. Therefore, the contradiction between the increase of propylene yield and the reduction of dry gas is relieved, and the yield of dry gas and coke is reduced while the propylene yield is increased.

U.S. Pat. No. 7,261,807 discloses a catalytic cracking process with increased propylene yield. In this process, at least a part of gasoline product is fed to a second riser reactor for further cracking reaction, and the catalyst composition used comprises, in addition to macroporous USY zeolite, a mesoporous zeolite such as ZSM-5 and an inorganic binder component with cracking activity, wherein the inorganic binder component comprises phosphorus, and its P/Al ratio is 0.1-10. This process can greatly increase the yield of light olefins, especially propylene.

Chinese patent application publication No. CN 1299403A discloses a two-stage catalytic cracking process for selectively producing $C_2$-$C_4$ light olefins from heavy feedstocks. Heavy feedstocks are converted into products with lower boiling points in a first reaction section consisting of a catalytic cracking device in the presence of a conventional macroporous zeolite catalytic cracking catalyst; the naphtha fraction of the products obtained with lower boiling points is sent to a second reaction section and contacted with a catalyst comprising a zeolite with 10-50% of average pore diameter less than 0.7 nanometer at a temperature of 500-600° C. to obtain a cracked product, in which the propylene yield is up to 16.8%.

There remains a need in the art for a catalytic conversion process and system that can produce gasoline and propylene in high yield while eliminating or overcoming at least some of the disadvantages of the prior arts described above.

SUMMARY OF THE INVENTION

It is an object of the present application to provide a catalytic conversion process and system for producing gasoline and propylene, which can provide a high yield of propylene and gasoline, as well as a low yield of alkanes, especially a low yield of methane and ethane.

To accomplish the above object, in an aspect, the present application provides a process for producing gasoline and propylene, comprising the steps of:

1) subjecting a feedstock oil to a first catalytic conversion reaction in a first catalytic conversion reaction device to obtain a first reaction product comprising propylene, $C_4$ olefin and a gasoline component;
2) separating the first reaction product to obtain a propylene fraction, a gasoline fraction, a fraction comprising $C_4$ olefin (also referred to as $C_4$ olefin-containing fraction), optionally a light cycle oil fraction and optionally a fluidized catalytic cracking gas oil (FGO) fraction;
3) subjecting the $C_4$ olefin-containing fraction obtained in step 2) and optionally a $C_4$ olefin-containing fraction from an external source to olefin oligomerization in an oligomerization reactor to obtain an oligomerization product comprising $C_{12}$ olefin (also referred to as $C_{12}$ olefin-containing oligomerization product), and optionally separating the oligomerization product to obtain a fraction comprising $C_{12}$ olefin;
4) recycling the $C_{12}$ olefin-containing oligomerization product or fraction to the first catalytic conversion reaction device, and/or sending the $C_{12}$ olefin-containing oligomerization product or fraction to a second catalytic conversion reaction device for second catalytic conversion reaction to obtain a second reaction product comprising propylene; and
5) optionally, subjecting the FGO fraction to a first hydrotreatment in a first hydrotreating reactor to obtain a hydrogenated FGO, and recycling at least a part of the hydrogenated FGO to the first catalytic conversion reaction device and/or sending it to the second catalytic conversion reaction device, and/or recycling the light cycle oil fraction to the first catalytic conversion reaction device and/or sending it to the second catalytic conversion reaction device.

In another aspect, the present application provides a system for producing gasoline and propylene, comprising a first catalytic conversion reaction device, a regenerator, an oil-catalyst separation device, a product separation device, an oligomerization reactor, optionally a rectifying column, and optionally a second catalytic conversion reaction device, wherein:

the first catalytic conversion reaction device is configured to perform a first catalytic conversion reaction on a feedstock oil therein to obtain a reaction effluent comprising a first reaction product and a spent catalyst, wherein the first reaction product comprises propylene, $C_4$ olefin and a gasoline component;

the oil-catalyst separation device is configured to separate the first reaction product from the spent catalyst in the reaction effluent of the first catalytic conversion reaction device, the regenerator is configured to regenerate the spent catalyst and recycle the regenerated catalyst to the first catalytic conversion reaction device, the product separation device is configured to separate the first reaction product to obtain a propylene fraction, a gasoline fraction, a fraction comprising $C_4$ olefin, optionally a light cycle oil fraction and optionally a FGO fraction, the oligomerization reactor is configured to conduct an olefin oligomerization on the fraction comprising $C_4$ olefin to obtain an oligomerization product comprising $C_{12}$ olefin, and send the oligomerization product to the optional rectifying column, or recycle the oligomerization product to the first catalytic conversion reaction device or send it to the optional second catalytic conversion reaction device;

the rectifying column, if present, is configured to separate the oligomerization product to obtain an oligomerization product or fraction comprising $C_{12}$ olefin, and recycle the oligomerization product or fraction comprising $C_{12}$ olefin to the first catalytic conversion reaction device or send it to the optional second catalytic conversion reaction device;

the second catalytic conversion reaction device, if present, is configured to perform a second catalytic conversion reaction on the oligomerization product or fraction comprising $C_{12}$ olefin to obtain a second reaction product comprising propylene.

When compared with the prior art, the process and the system of the present application have one or more of the following advantages:

(1) optimizing the product distribution, specifically by reducing the yield of coke and dry gas, and improving the yield of light oil;

(2) improving the propylene yield by subjecting $C_4$ olefin to oligomerization and then feeding the resulting $C_{12}$ olefin to a catalytic conversion reaction device; and (3) further improving the propylene yield by recycling a light cycle oil fraction (particularly a light cycle oil fraction having a distillation range of 200-260° C.) to the first catalytic conversion reaction device and/or the second catalytic conversion reaction device; and/or treating a FGO fraction (particularly a FGO fraction having a distillation range >260° C.) in the first hydrotreatment device and then recycling to the first catalytic conversion reaction device and/or the second catalytic conversion reaction device.

Additional characteristics and advantages of the present application will be described in detail hereinbelow.

BRIEF DESCRIPTION OF THE DRAWINGS

The drawings, forming a part of the present description, are provided to help the understanding of the present application, and should not be considered to be limiting. The present application can be interpreted with reference to the drawings in combination with the detailed description hereinbelow. In the drawings.

Description of the reference numerals

Figure 1:
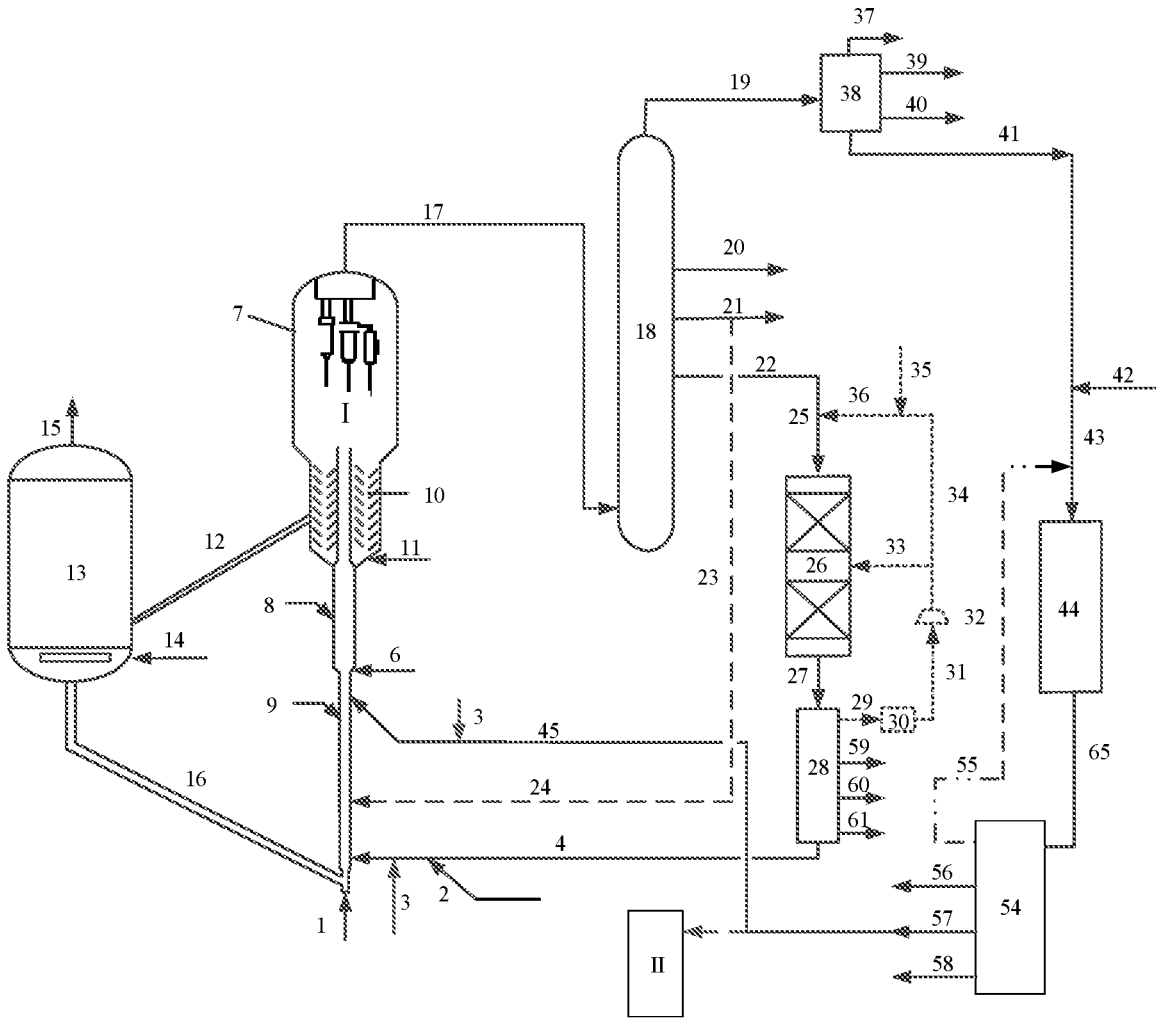
FIG. 1 is a schematic diagram of a first embodiment of the process and system of the present application.

| | | |
|---|---|---|
| 1 pipeline | 2 pipeline | 3 pipeline |
| 4 pipeline | 5 pipeline | 6 pipeline |
| 7 disengager | 8 second reaction zone | 9 first reaction zone |
| 10 stripping section | 11 pipeline | 12 pipeline |
| 13 regenerator | 14 pipeline | 15 pipeline |
| 16 pipeline | 17 pipeline | 18 fractionation device |
| 19 pipeline | 20 pipeline | 21 pipeline |
| 22 pipeline | 23 pipeline | 24 pipeline |
| 25 pipeline | 26 first hydrotreating reactor | 27 pipeline |
| 28 hydrogenation separation device | 29 pipeline | 30 recycle hydrogen treater |
| 31 pipeline | 32 recycle compressor | 33 pipeline |
| 34 pipeline | 35 pipeline | 36 pipeline |
| 37 pipeline | 38 $C_4$ separation device | 39 pipeline |
| 40 pipeline | 41 pipeline | 42 pipeline |
| 43 pipeline | 44 oligomerization device | 45 pipeline |
| 46 pipeline | 47 second hydrotreating reactor | 48 pipeline |
| 49 hydrogenation separation device | 50 pipeline | 51 pipeline |
| 52 pipeline | 53 pipeline | 54 rectifying column |
| 55 pipeline | 56 pipeline | 57 pipeline |
| 58 pipeline | 59 pipeline | 60 pipeline |
| 61 pipeline | 62 pipeline | 63 pipeline |
| 64 pipeline | 65 pipeline | 66 dense phase bed unit |
| I first catalytic conversion reaction device | II second catalytic conversion reaction device | |

DETAILED DESCRIPTION OF THE INVENTION

The present application will be further described hereinafter in detail with reference to particular embodiments thereof and the accompanying drawings. It should be noted that the particular embodiments of the present application are provided for illustration purpose only, and are not intended to be limiting in any manner.

As described above, in a first aspect, the present application provides a process for producing gasoline and propylene, comprising the steps of:

1) subjecting a feedstock oil to a first catalytic conversion reaction in a first catalytic conversion reaction device to obtain a first reaction product comprising propylene, $C_4$ olefin and a gasoline component;

2) separating the first reaction product to obtain a propylene fraction, a gasoline fraction, a fraction comprising $C_4$ olefin, optionally a light cycle oil fraction and optionally a FGO fraction;

3) subjecting the $C_4$ olefin-containing fraction obtained in step 2) and optionally a $C_4$ olefin-containing fraction from an external source to olefin oligomerization in an oligomerization reactor to obtain an oligomerization product comprising $C_{12}$ olefin, and optionally separating the oligomerization product to obtain a fraction comprising $C_{12}$ olefin;

4) recycling the $C_{12}$ olefin-containing oligomerization product or fraction to the first catalytic conversion reaction device, and/or sending the $C_{12}$ olefin-containing oligomerization product or fraction to a second catalytic conversion reaction device for second catalytic conversion reaction to obtain a second reaction product comprising propylene; and 5) optionally, subjecting the FGO fraction to a first hydrotreatment in a first hydrotreating reactor to obtain a hydrogenated FGO, and recycling at least a part of the hydrogenated FGO to the first catalytic conversion reaction device and/or sending it to the second catalytic conversion reaction device, and/or recycling the light cycle oil fraction to the first catalytic conversion reaction device and/or sending it to the second catalytic conversion reaction device.

The inventors of the present application have surprisingly found that the propylene yield can be significantly improved by separating a fraction comprising $C_4$ olefin from the catalytic conversion product for olefin oligomerization, and recycling $C_{12}$ olefin in the oligomerization product to the catalytic conversion reaction device for further catalytic conversion reaction.

In the present application, the olefin oligomerization may be those well known to those skilled in the art, and is used to oligomerize $C_4$ olefin to $C_{12}$ olefin. Preferably, the oligomerization reaction can be carried out in the presence of an oligomerization catalyst and under conditions including: a temperature of about 50-500° C., preferably about 60-400° C., a pressure of about 0.5-5.0 MPa, and a weight hourly space velocity of about 0.1-100 $h^{-1}$.

According to the present application, the oligomerization catalyst may be one or more selected from the group consisting of phosphoric acid catalysts, acidic resins, silica-alumina solid acid catalysts, and zeolite solid acid catalysts, wherein the phosphoric acid catalyst can be one or more selected from a catalyst formed by loading phosphoric acid on diatomite, a catalyst formed by loading phosphoric acid on activated carbon, a catalyst formed from phosphoric acid-soaked quartz sand, a catalyst formed by loading phosphoric acid on silica gel and a catalyst formed by loading copper pyrophosphate on silica gel; the silica-alumina solid acid catalyst can be a catalyst formed by loading metal ion(s) on alumina and/or amorphous silica-alumina carrier, wherein the loaded metal ions are selected from Group VIII metals, Group IVA metals or a combination thereof; the zeolite solid acid catalyst may comprise about 10-100 wt % of a zeolite and about 0-90 wt % of a matrix, based on the weight of the zeolite solid acid catalyst, wherein the zeolite is one or more selected from the group consisting of one-dimensional zeolites, two-dimensional zeolites, and three-dimensional zeolites. Preferably, the one-dimensional zeolite is selected from MTW (ZSM-12), MTT (ZSM-23) and TON (ZSM-22) zeolites, the two-dimensional zeolite is selected from FER (ferrierite), MFS (ZSM-57), MWW (MCM-22) and MOR (mordenite) zeolites, and the three-dimensional zeolite is selected from beta zeolites. Further preferably, the zeolite is selected from ZSM-5 zeolites. In the present application, the one-, two- and three-dimensional zeolites are classified according to the channel system characteristics of the zeolites, of which the meaning is well known to those skilled in the art and thus is omitted herein for brevity.

The oligomerization reaction involved in the present application is one in which reaction conditions are controlled and catalyst is carefully selected to maximize the production of $C_{12}$ olefin. The $C_4$ olefin serving as the oligomerization feedstock may come from devices including, but not limited to: the first catalytic conversion reaction device, said other catalytic conversion reaction device(s), and other units of which the product comprises $C_4$ olefin; for example, from various units of refineries or chemical plants, wherein the refinery unit may be selected from a catalytic conversion reaction device that is at least one selected from the group consisting of various catalytic cracking units, catalytic conversion units for producing isoparaffins in a higher yield, deep catalytic cracking units (for example, DCC unit), and catalytic thermal cracking units, and/or a thermal conversion unit that is at least one selected from the group consisting of various thermal cracking units, and various coking units (for example, delayed coking unit); and the chemical plant unit may be selected from a steam cracking unit and/or an olefin oligomerization unit. The $C_4$ olefin can be obtained by those skilled in the art according to production needs and practical situations, of which the detailed description is omitted herein for brevity.

In a preferred embodiment, the $C_{12}$ olefin content of the resulting oligomerization product is no less than about 20 wt %, for example no less than about 40 wt %, no less than about 50 wt %, no less than about 70 wt %, or no less than about 80 wt %, based on the weight of the oligomerization product.

In a preferred embodiment, the $C_{12}$ olefin-containing fraction obtained in step 3) has a $C_{12}$ olefin content of no less than about 40 wt %, for example no less than about 50 wt %, no less than about 70 wt %, no less than about 80 wt % or no less than about 90 wt %, based on the weight of the $C_{12}$ olefin-containing fraction, and is preferably essentially consisted of $C_{12}$ olefin.

According to the present application, the oligomerization reaction can be further promoted by optimizing the $C_4$ olefin content and the impurity content in the $C_4$ olefin-containing fraction. For example, the $C_4$ olefin-containing fraction preferably has a $C_4$ olefin content of about 40 wt % to about 100 wt %, based on the weight of the $C_4$ olefin-containing fraction.

According to the present application, it is preferable that the $C_4$ olefin-containing fraction is pretreated prior to the oligomerization reaction, so that it may have a sulfur content of no more than about 20 μg/g, a basic nitride content of no more than about 0.6 μg/g, a water content of about 600-1800 μg/g, and a diene content of no more than about 200 μg/g.

In some preferred embodiments, the $C_{12}$ olefin recycled to the first catalytic conversion reaction device and/or sent to the second catalytic conversion reaction device in step 4) accounts for about 0.1 wt % to about 80 wt %, preferably about 1 wt % to about 70 wt %, of the total amount of the catalytic conversion feedstock, including all fresh feedstock oil and recycle stream(s), such as recycled $C_{12}$ olefin, introduced into the first and second catalytic conversion reaction devices.

In some preferred embodiments of the present application, to further increase the utilization of $C_4$ olefin, the process may further comprise: recycling the residual of the oligomerization product after separating the fraction comprising $C_{12}$ olefin to the oligomerization reactor for further oligomerization, or further separating $C_4$ olefin from the residual of the oligomerization product after separating the fraction comprising $C_{12}$ olefin, and then recycling the $C_4$ olefin to the oligomerization reaction.

In some preferred embodiments of the present application, to further increase the propylene yield, the process may further comprise: in step 5), recycling the light cycle oil fraction obtained in step 2) (especially the light cycle oil fraction having a distillation range of 200-260° C.) to the first catalytic conversion reaction device and/or the second catalytic conversion reaction device; and/or recycling the FGO fraction obtained in step 2) (especially the FGO fraction having a distillation range >260° C.) to the first catalytic conversion reaction device and/or the second catalytic conversion reaction device after being hydrogenated in a first hydrotreating reactor.

According to the present application, the feedstock oil used for the first catalytic conversion reaction may be those well known to those skilled in the art. For example, the feedstock oil may be selected from petroleum hydrocarbons, other mineral oils, or a combination thereof, wherein the petroleum hydrocarbon may be one or more selected from the group consisting of atmospheric gas oil, vacuum gas oil, atmospheric residue, vacuum residue, hydrogenated residue, coker gas oil, and deasphalted oil; said other mineral oil may be one or more selected from the group consisting of coal and natural gas derived liquid oil, oil sand oil, tight oil and shale oil. Preferably, the property of the feedstock oil satisfies at least one of the following criteria: a density of about 900-1000 kg/m$^3$, preferably about 930-960 kg/m$^3$, a carbon residue of about 4-15 wt %, preferably about 6-12 wt %, a metal content of about 15-600 ppm, preferably about 15-100 ppm, and an acid value of about 0.5-20 mg KOH/g, preferably about 0.5-10 mg KOH/g.

According to the present application, the process may further comprise: before step 1), contacting the feedstock oil with a second hydrotreating catalyst in a second hydrotreating reactor for a second hydrotreatment, and sending the resulting hydrogenation product to the first catalytic conversion reaction device. Preferably, the yield of the hydrogenation product is controlled to be 85-95 wt %, based on the weight of the feedstock oil, and the initial boiling point of the hydrogenation product is 330-350° C.

According to the present application, the second hydrotreatment can be carried out under conditions including: a hydrogen partial pressure of about 3.0-20.0 MPa, a reaction temperature of about 300-450° C., a hydrogen-to-oil volume ratio of about 100-2000 standard cubic meters/cubic meter, and a volume space velocity of about 0.1-3.0 h$^{-1}$.

According to the present application, the second hydrotreating catalyst comprises about 70-99 wt % of a carrier that is one or more selected from the group consisting of alumina, silica and amorphous silica-alumina, and about 0.1-30 wt % of an active metal (calculated as oxide) that may be selected from Group VIB metals, Group VIII metals or combinations thereof. Preferably, the carrier may comprise about 2-15 wt % of Al and about 5-30 wt % of P, based on the weight of the carrier, and the catalyst may comprise about 5-40 wt % of a Group VIB metal oxide, and about 1-12 wt % of a Group VIII metal oxide, based on the weight of the catalyst. The second hydrotreating catalyst may be filled in the second hydrotreating reactor according to a certain grading, wherein the catalyst grading refers to the catalyst grading filling of a hydrogenation protective agent, a hydrodemetallization catalyst, a hydrodesulfurization catalyst and a hydrodenitrogenation catalyst for carbon residue removal throughout the hydrogenation catalyst bed according to the physical and chemical properties such as the size, pore diameter and activity of the catalyst. Preferably, the hydrodemetallization catalyst in the catalyst grading makes up no less than 30 wt % of the total catalyst weight. Preferably, the catalyst grading involves, based on the weight of the total catalyst, about 20-70 wt %, preferably about 30-50 wt %, of a guard/demetallization catalyst; about 20-70 wt %, preferably about 40-60 wt %, of a desulfurization catalyst; and about 0-60 wt %, preferably about 10-40 wt % of a catalyst for denitrification/carbon residue removal. According to the present application, the second hydrotreating catalyst may be a hydrotreating catalyst and/or an upgrading catalyst conventionally used in the art. By using the second hydrotreatment, the quality of the feedstock oil can be improved, and the yield of catalytic conversion gasoline and propylene can be improved.

According to the present application, a FGO can be separated from the resulting first reaction product and/or second reaction product, and then sent to a first hydrotreating reactor to contact with a first hydrotreating catalyst for a first hydrotreatment to obtain a hydrogenated FGO. Preferably, the first hydrotreatment can be carried out under conditions including: a hydrogen partial pressure of about 3.0-20.0 MPa, preferably 4-16 MPa, a reaction temperature of about 300-450° C., preferably 320-420° C., a volume space velocity of about 0.1-10.0 h$^{-1}$, preferably 0.1-5.0 h$^{-1}$, and a hydrogen-to-oil volume ratio of about 100-1500 standard cubic meters/cubic meter (Nm$^3$/m$^3$). The first hydrotreating catalyst may comprise about 60-99 wt % of a carrier that may be one or more selected from the group consisting of alumina, silica, and amorphous silica-alumina, and about 5-40 wt % of an active metal (calculated as oxide) that may be selected from Group VIB metals, Group VIII metals, or a combination thereof. Preferably, the carrier may comprise about 1-10 wt % of Al and about 5-20 wt % of P, based on the weight of the carrier, and the catalyst may comprise about 10-35 wt % of a VIB metal oxide, and about 1-10 wt % of a Group VIII metal oxide, based on the weight of the catalyst.

According to the present application, the "fluidized catalytic cracking gas oil (FGO)" refers to the bottom heavy fraction of a catalytic conversion fractionation column, and is a catalytic conversion slurry oil obtained from conventional catalytic conversion fractionation columns. The FGO has a cut point generally not lower than about 250° C., preferably not lower than about 300° C., and more preferably not lower than about 330° C. For example, its distillation range may be about 250-700° C., preferably about 280-470° C., its density may be about 0.89-1.2 g/cm$^3$, its hydrogen content may be not lower than about 10.5 wt %, preferably not lower than about 10.8 wt %, and its solid particle content may be about 0.1-10 g/l. In addition, the product obtained from the hydrotreatment may be subjected to gas-liquid separation to remove light hydrocarbons and hydrogen, so that the hydrogenation FGO can be obtained. In the hydrogenated FGO obtained after the hydrotreatment, polycyclic aromatic hydrocarbons are saturated to generate aromatic hydrocarbons having two rings or lower, so that the catalytic conversion capability of the FGO can be greatly improved, and thus its recycle to the first or second catalytic conversion reaction device and/or introduction into other catalytic conversion reaction device(s) for further reaction can lead to a production of more high-quality fuel oil.

The catalytic conversion reaction device used in the present application may be those well known to those skilled in the art. For example, the first catalytic conversion reaction device and the second catalytic conversion reaction device, if present, may each independently be a fluidized bed reactor.

In the present application, the term "fluidized bed reactor" should be understood in its broadest sense, and includes various forms of reactors for bringing a gaseous feedstock into contact with solid catalyst particles present in a fluidized state for a chemical reaction, including but not limited to dense phase bed, bubbling bed, turbulent bed, fast bed, gas phase transport bed (such as upward bed and downer bed), and the like, and may be a constant-linear-velocity fluidized bed reactor, an equal-diameter fluidized bed reactor, a diameter-transformed fluidized bed reactor, and the like, or alternatively a composite reactor resulting from a combination of two or more different types of fluidized beds connected in series, and is preferably a riser reactor or a composite reactor combining a riser with a dense phase bed. Typically, the gas velocity of the dense phase bed is in a range of about 0.1-2 m/s, while the gas velocity of the riser is in a range of about 2-30 m/s (excluding the catalyst). In a preferred embodiment, the riser reactor may be an equal-diameter riser reactor, a constant-linear-velocity riser reactor or a diameter-transformed riser reactor.

In a preferred embodiment, the first catalytic conversion reaction device and/or the second catalytic conversion reaction device is a diameter-transformed riser reactor, and the diameter-transformed riser reactor may sequentially comprise, from bottom to top in a vertical direction, a pre-lift section, a first reaction zone, a second reaction zone with a diameter larger than that of the first reaction zone, and an outlet zone with a diameter smaller than that of the second reaction zone arranged coaxially, and the outlet zone is connected at its end to a disengager through a horizontal pipe, and the total height of the reactor is about 10-60 meters, wherein a cracking reaction occurs in the first reaction zone, and a hydrogen transfer reaction and an isomerization reaction occur in the second reaction zone. The diameter of the pre-lift section is the same as that of a conventional equal-diameter riser reactor, and is generally about 0.02-5 meters, and the height of the pre-lift section is about 5-10% of the total height of the reactor. The first reaction zone has a structure similar to a conventional equal-diameter riser reactor and may have a diameter equal to or slightly larger than that of the pre-lift section, with the ratio of the diameter of the first reaction zone to that of the pre-lift section being about 1.0-2.0:1, and the height of the first reaction zone being about 10-30% of the total height of the reactor. After mixed in this zone, the feedstock oil and the catalyst are subjected primarily to a cracking reaction at a relatively higher reaction temperature and catalyst-to-oil weight ratio for a relatively shorter residence time (typically about 0.5-3.0 seconds). The diameter of the second reaction zone is larger than that of the first reaction zone, with the ratio of the diameter of the second reaction zone to that of the first reaction zone being about 1.5-5.0:1, and the height of the second reaction zone being about 30-60% of the total height of the reactor, so that the flow rate of oil gas and catalyst can be reduced and the reaction temperature can be regulated. For a more detailed description of the reactor, reference may be made to Chinese patent No. ZL99105903.4, the contents of which are incorporated herein by reference in their entirety.

The catalytic conversion catalyst used in the present application may be those well known to those skilled in the art. For example, the catalyst for the first catalytic conversion reaction and the catalyst for the second catalytic conversion reaction, if present, may each be independently selected from amorphous silica-alumina catalysts, zeolite catalysts, or a combination thereof, and the zeolite in the zeolite catalyst may be one or more selected from the group consisting of Y zeolite, HY zeolite, ultrastable Y zeolite, ZSM-5 series zeolite, high-silica zeolite having a pentasil structure, and ferrierite. The zeolite may or may not comprise rare earth and/or phosphorus. When the catalytic conversion reaction device used has a plurality of reaction zones, the catalysts fed to the different reaction zones of the catalytic conversion reaction device may be of the same type or of different types. The different types of catalysts may be catalysts having different particle sizes and/or catalysts having different apparent bulk densities. Catalysts having different particle sizes and/or different apparent bulk densities can be injected to different reaction zones, respectively. For example, a catalyst comprising an ultrastable Y zeolite and having a large particle size is introduced into a first reaction zone to promote cracking reaction, a catalyst comprising a REY zeolite and having a small particle size of is introduced into a second reaction zone to promote hydrogen transfer reaction, the catalysts with different particle sizes are stripped in the same stripper and regenerated in the same regenerator, then the catalyst having a large particle size is separated from the catalyst having a small particle size, and the catalyst having a small particle size is cooled and introduced into the second reaction zone. Catalysts with different particle sizes are divided at a boundary between about 30-40 microns and catalysts with different apparent bulk densities are divided at a boundary between about 0.6-0.7 $g/cm^3$.

In the present application, the catalyst for the first catalytic conversion reaction and the catalyst for the second catalytic conversion reaction, if present, may be those well known to those skilled in the art, and may, for example, each independently comprise about 1-50 wt % of a zeolite, about 5-99 wt % of an inorganic oxide, and about 0-70 wt % of clay. In the catalyst, the zeolite is used as an active component, and the zeolite may be selected from mesoporous zeolites, macroporous zeolites, or a combination thereof. Preferably, the mesoporous zeolite may account for about 50-100 wt %, preferably about 70-100 wt %, of the total weight of the zeolite, and the macroporous zeolite may account for about 0-50 wt %, preferably about 0-30 wt %, of the total weight of the zeolite. The mesoporous zeolite may be selected from ZSM series zeolites, ZRP zeolites, or combinations thereof. Optionally, the mesoporous zeolite may be modified with a non-metal element such as phosphorus and/or a transition metal element such as iron, cobalt, nickel. For a more detailed description of ZRP zeolites, reference may be made to U.S. Pat. No. 5,232,675, the contents of which are incorporated herein by reference. The ZSM-series zeolite may be selected from the group consisting of ZSM-5, ZSM-11, ZSM-12, ZSM-22, ZSM-35, ZSM-38, ZSM-48, other zeolites having a similar structure, or mixtures thereof. More detailed description of ZSM-5 and the like may be found in U.S. Pat. No. 3,702,886, the contents of which are incorporated herein by reference. The macroporous zeolite may be one or more selected from the group consisting of REY zeolite, REHY zeolite, ultrastable Y zeolite and high-silica Y zeolite. In the catalyst, the inorganic oxide is used as a binder, and may be selected from silicon dioxide ($SiO_2$) and/or aluminum oxide ($Al_2SiO_3$). In the catalyst, the clay is used as a matrix (i.e., carrier) and may be selected from kaolin and/or halloysite.

In some preferred embodiments, the $C_{12}$ olefin-containing oligomerization product or fraction and the hydrogenated FGO are recycled to the first catalytic conversion reaction device, where they may be fed to the first catalytic conversion reaction device at any position. For example, the feedstock oil, the hydrogenated FGO and the $C_{12}$ olefin-containing oligomerization product or fraction may be fed into the first catalytic conversion reaction device at the same feed point, or at two or more feed points.

In a preferred embodiment, the first catalytic conversion reaction device is a fluidized bed reactor, and the reaction conditions of the first catalytic conversion reaction device include: a reaction temperature of about 420-650° C., a reaction time of about 0.05-20 seconds, a catalyst-to-feedstock weight ratio of about 3:1 to about 15:1, and a steam-to-feedstock weight ratio of about 0.03:1 to about 0.5:1;

preferably, the reaction conditions include: a reaction temperature of about 480-600° C., a reaction time of about 0.1-15 seconds, a catalyst-to-feedstock weight ratio of about 4:1 to about 12:1, and a steam-to-feedstock weight ratio of about 0.05:1 to about 0.3:1.

In a further preferred embodiment, the first catalytic conversion reaction is carried out to the extent that a gaseous product having one or more of the following characteristics is obtained:

- a mass fraction ratio of liquefied gas ($C_3$ and $C_4$) to dry gas ($C_2$ or lower) of not less than about 7, preferably not less than about 10;
- a methane yield of no greater than about 2.0%, preferably no greater than about 1.0%;
- a mass fraction ratio of propylene to propane in the liquefied gas of not less than about 3.5, preferably not less than about 5.0; and
- a mass fraction ratio of isobutylene to isobutane of not less than about 1.5, preferably not less than about 4.0.

In a further preferred embodiment, the first catalytic conversion reaction device is a diameter-transformed riser reactor, and the diameter-transformed riser reactor comprises, along the flow direction of the reaction stream, a first reaction zone and a second reaction zone with a diameter larger than that of the first reaction zone, wherein the reaction conditions in the first reaction zone of the diameter-transformed riser reactor include: a reaction temperature of about 450-620° C., preferably about 500-600° C., a reaction time of about 0.5-2.0 seconds, preferably about 0.8-1.5 seconds, a catalyst-to-feedstock weight ratio of about 3:1 to about 15:1, preferably about 4:1 to about 12:1, and a steam-to-feedstock weight ratio of about 0.03:1 to about 0.3:1, preferably about 0.05:1 to about 0.15:1; the reaction conditions in the second reaction zone include: a reaction temperature of about 460-550° C., preferably about 480-530° C., a reaction time of about 2-30 seconds, preferably about 3-15 seconds, a catalyst-to-feedstock weight ratio of about 4:1 to about 18:1, preferably about 4.5:1 to about 15:1, and a steam-to-feedstock weight ratio of about 0.03:1 to about 0.3:1, preferably about 0.05:1 to about 0.15:1. Further preferably, the $C_2$ olefin-containing oligomerization product or fraction is recycled to the second reaction zone of the diameter-transformed riser reactor in step 4) and/or at least a part of the hydrogenated FGO and/or the light cycle oil fraction is recycled to the first reaction zone of the diameter-transformed riser reactor in step 5).

According to the present application, the reaction conditions of the second catalytic conversion reaction and the first catalytic conversion reaction may be the same or different, for example, the conditions of the second catalytic conversion reaction may include: a reaction temperature of about 450-620° C., a reaction time of about 0.5-20.0 seconds, preferably about 2-20 seconds, a catalyst-to-oil weight ratio of about 1-25, and a steam-to-oil weight ratio of about 0.03-0.3.

According to the present application, the catalytic conversion product can be separated to obtain dry gas, propane, propylene, $C_{5+}$ gasoline and the like. in addition to the above-mentioned fractions. The method for separating the fraction comprising $C_4$ olefin may be those well known to those skilled in the art, and preferably comprises extractive distillation using acetonitrile as a solvent, wherein a $C_4$ fraction can be first separated by fractionation, and then the paraffins in the $C_4$ fraction can be further separated to obtain the fraction comprising $C_4$ olefin. Since catalysts are susceptible to be poisoned by dienes, and an excessively high level of sulfur, especially mercaptan and hydrogen sulfide, may reduce the activity of the oligomerization catalyst and promote the formation of resin in the oligomerization gasoline, the fraction comprising $C_4$ olefin can be treated by a pretreatment unit, such as, for removing dienes by selective hydrogenation, for desulfurization using ethanolamine, for alkali washing and water washing, and for removing basic nitride compounds, and then subjected to oligomerization. The above-mentioned treatments are well known to those skilled in the art, of which the detailed description is omitted herein for brevity.

In a second aspect, the present application provides a system for producing gasoline and propylene, the system comprising a first catalytic conversion reaction device, a regenerator, an oil-catalyst separation device, a product separation device, an oligomerization reactor, optionally a rectifying column, and optionally a second catalytic conversion reaction device, wherein:

- the first catalytic conversion reaction device is configured to perform a first catalytic conversion reaction on a feedstock oil therein to obtain a reaction effluent comprising a first reaction product and a spent catalyst, wherein the first reaction product comprises propylene, $C_4$ olefin and a gasoline component;
- the oil-catalyst separation device is configured to separate the first reaction product from the spent catalyst in the reaction effluent of the first catalytic conversion reaction device,
- the regenerator is configured to regenerate the spent catalyst and recycle the regenerated catalyst to the first catalytic conversion reaction device,
- the product separation device is configured to separate the first reaction product to obtain a propylene fraction, a gasoline fraction, a fraction comprising $C_4$ olefin, optionally a light cycle oil fraction and optionally a FGO fraction,
- the oligomerization reactor is configured to conduct an olefin oligomerization on the fraction comprising $C_4$ olefin to obtain an oligomerization product comprising $C_{12}$ olefin, and send the oligomerization product to the optional rectifying column, or recycle the oligomerization product to the first catalytic conversion reaction device or send it to the optional second catalytic conversion reaction device;
- the rectifying column, if present, is configured to separate said oligomerization product to obtain a fraction comprising $C_{12}$ olefin, and recycle the fraction comprising $C_{12}$ olefin to the first catalytic conversion reaction device or send it to the optional second catalytic conversion reaction device;
- the second catalytic conversion reaction device, if present, is configured to perform a second catalytic conversion reaction on the oligomerization product or fraction comprising $C_{12}$ olefin to obtain a second reaction product comprising propylene.

In a preferred embodiment, the first catalytic conversion reaction device is provided with a catalyst inlet, at least one catalytic conversion feedstock inlet and an oil-catalyst outlet, the regenerator is provided with a catalyst inlet and a catalyst outlet, the oil-catalyst separation device is provided with an oil-catalyst inlet, an oil-gas outlet and a catalyst outlet, the product separation device is provided with at least an oil-gas inlet and a $C_4$ olefin-containing fraction outlet, the oligomerization reactor is provided with a feedstock inlet and an oligomerization product outlet, the rectifying column is provided with an oil-gas inlet, a $C_{12}$ olefin-containing fraction outlet and a separated product outlet, and the second catalytic conversion reaction device is provided with a catalyst inlet, a feedstock inlet and an oil-catalyst outlet;

the catalyst inlet of the first catalytic conversion reaction device is in fluid communication with the catalyst outlet of the regenerator, the oil-catalyst outlet of the first catalytic conversion reaction device is in fluid communication with the oil-catalyst inlet of the oil-catalyst separation device, the catalyst outlet of the oil-catalyst separation device is in fluid communication with the catalyst inlet of the regenerator, the oil-gas outlet of the oil-catalyst separation device is in fluid communication with the oil-gas inlet of the product separation device, the $C_4$ olefin-containing fraction outlet of the product separation device is in fluid communication with the feedstock inlet of the oligomerization reactor, the oligomerization product outlet of the oligomerization reactor is in fluid communication with the oil-gas inlet of the rectifying column, and the $C_{12}$ olefin-containing fraction outlet of the rectifying column is in fluid communication with one catalytic conversion feedstock inlet of the first catalytic conversion reaction device or the feedstock inlet of the second catalytic conversion reaction device;

preferably, the system further comprises a first hydrotreating reactor, the product separation device is further provided with a FGO outlet, the feedstock inlet of the first hydrotreating reactor is in fluid communication with the FGO outlet of the product separation device, and the product outlet of the first hydrotreating reactor is in fluid communication with one catalytic conversion feedstock inlet of the first catalytic conversion reaction device or the feedstock inlet of the second catalytic conversion reaction device; and further preferably, the product separation device is further provided with a light cycle oil fraction outlet, and the light cycle oil fraction outlet of the product separation device is in fluid communication with one catalytic conversion feedstock inlet of the first catalytic conversion reaction device or the feedstock inlet of the second catalytic conversion reaction device.

In a preferred embodiment, the first catalytic conversion reaction device is a diameter-transformed riser comprising a first reaction zone and a second reaction zone along the flow direction of the reaction stream, wherein the bottom of the second reaction zone is provided with one or more chilling/heating medium inlets, and/or the second reaction zone is provided with a heat remover, and the height of the heat remover is about 50-90% of the height of the second reaction zone.

In a preferred embodiment, the system further comprises a second hydrotreating reactor, the second hydrotreating reactor is provided with a feedstock oil inlet and a product outlet, and the product outlet of the second hydrotreating reactor is in fluid communication with one catalytic conversion feedstock inlet of the first catalytic conversion reaction device; the product separation device is further provided with a light cycle oil outlet, and the light cycle oil outlet of the product separation device is in fluid communication with one catalytic conversion feedstock inlet of the first catalytic conversion reaction device. By using the second hydrotreating reactor, the quality of feedstock oil can be improved, and the yield of catalytic conversion gasoline and propylene can be improved.

The various reactors and devices in the system of the present application can be those well known to those skilled in the art, of which the detailed description is omitted for brevity.

The present application will be further described with reference to the accompanying drawings, but is not limited thereto.

The first type of embodiments is described hereinbelow with reference to FIG. 1.

In FIG. 1, a preheated feedstock oil from pipeline 2 is atomized by an atomizing steam from pipeline 3, and is pre-lifted by pre-lifting steam from pipeline 1, and then is fed to a first reaction zone 9 of a first catalytic conversion reaction device I, that is a diameter-transformed riser reactor, to contact with a regenerated catalyst from pipeline 16 to perform a first catalytic conversion reaction. The resulting oil gas and the catalyst are conveyed upwards, and optionally further reacted with a hydrogenated FGO from pipeline 4 that is atomized by an atomizing steam from pipeline 3. The resulting oil gas and the catalyst are conveyed upwards to a second reaction zone 8 of the first catalytic conversion reaction device I for further reaction. The resulting first reaction product and the first spent catalyst are subjected to oil gas and catalyst separation in a disengager 7, the separated spent catalyst deposited with carbon is subjected to stripping by steam from pipeline 11 in a stripping section 10 to strip off the oil gas carried, and then passed to a regenerator 13 through pipeline 12 for coke burning. The resulting flue gas is discharged from the regenerator via pipeline 15. In regenerator 13, the air from pipeline 14 burns off the coke on the catalyst to restore its activity, and then the catalyst is recycled to the bottom of the first reaction zone 9 via pipeline 16 for reaction. The separated first reaction product is passed to a fractionation device 18 through pipeline 17, light hydrocarbon components obtained in the fractionation device 18 are passed to a $C_4$ separation device 38 through pipeline 19 to obtain a dry gas withdrawn through pipeline 37, propylene withdrawn through pipeline 39, other components of liquefied gas withdrawn through pipeline 40 and a fraction comprising $C_4$ olefin withdrawn through pipeline 41; $C_{5+}$ gasoline obtained from the fractionation device 18 is output from the device through pipeline 20 after being blended, the fraction comprising $C_4$ olefin obtained by fractionation is optionally mixed through pipeline 41 with external $C_4$ olefin from pipeline 42, and fed to an oligomerization device 44 through pipeline 43 for olefin oligomerization. The resulting oligomerization product is passed to a rectifying column 54 through pipeline 65 for separation, the fraction comprising $C_{12}$ olefin obtained by separation is fed to the bottom of the second reaction zone 8 of the first catalytic conversion reaction device I or a second catalytic conversion reaction device II through pipeline 57 and pipeline 45. Unconverted $C_4$ olefin is recycled to the oligomerization reactor 44 through pipeline 55, and the reaction products $C_8$ olefin and $C_{16}$ olefin are output from the device or optionally recycled to the first reaction zone 9 of the first catalytic conversion reaction device I or the second catalytic conversion reaction device II through pipeline 56 and pipeline 58, respectively. The light cycle oil obtained from the fractionation device 18 is recycled to the first catalytic conversion reaction device I through pipelines 21, 23 and 24, the FGO obtained from the fractionation device 18 is withdrawn through pipeline 22, and then sent to the first hydrotreating reactor 26 through pipeline 25 together with hydrogen from pipeline 36. The resulting reaction product is passed to a hydrogenation separation device 28 through pipeline 27, and the separated hydrogenated FGO is fed to the bottom of the first reaction zone 9 or the second catalytic conversion reaction device II through pipeline 4; the cracked gas, gasoline and diesel oil separated by the hydrogenation separation device 28 are output from the device through pipeline 59, pipeline 60 and pipeline 61, respectively; the hydrogen separated by the hydrogenation separation device 28 is sent to a recycle hydrogen treater 30 through pipeline 29, then sent to a recycle compressor 32 through pipeline 31, and the pressurized hydrogen is returned to the first hydrotreating reactor 26 through pipeline 33, or is mixed through pipeline 34 with fresh hydrogen from pipeline 35, recycled through pipeline 36, mixed with the hydrogenation feedstock and then returned to the first hydrotreating reactor 26. Pipeline 6 is used for the injection of a stream for adjusting the temperature of the second reaction zone 8.

A second type of embodiments is described hereinbelow with reference to FIG. 2.

Figure 2:
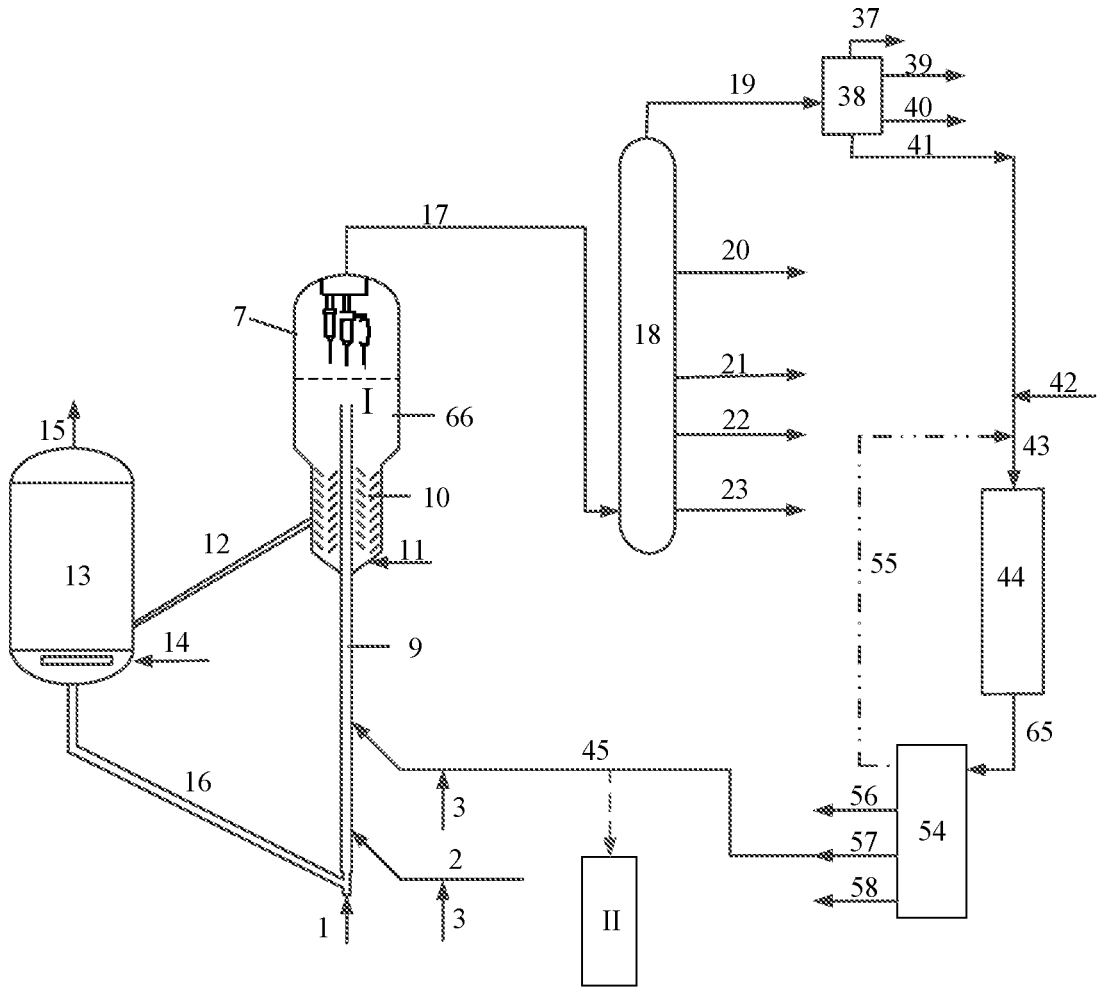
FIG. 2 is a schematic diagram of a second embodiment of the process and system of the present application.

In FIG. 2, a preheated feedstock oil from pipeline 2 and an atomizing steam from pipeline 3 are mixed and fed into a first reaction zone 9 (a riser unit) of a first catalytic conversion reaction device I, which is a combined reactor comprising a riser connected in series with a dense phase bed, to contact with a regenerated catalyst from pipeline 16, and pre-lifted by pre-lifting steam from pipeline 1. The resulting oil gas and the catalyst are conveyed upwards, and optionally reacted with a fraction comprising $C_{12}$ olefin from pipeline 45 atomized by an atomizing steam from pipeline 3. The resulting oil gas and catalyst are conveyed upwards to the dense phase bed unit 66 for further reaction. The resulting first reaction product and the first spent catalyst are subjected to oil gas and catalyst separation in a disengager 7, the separated spent catalyst deposited with carbon is subjected to stripping by steam from steam pipeline 11 in a stripping section 10 to stripped off the oil gas carried, and the catalyst is passed to a regenerator 13 through pipeline 12 for coke burning, and the resulting flue gas is discharged from the regenerator through pipeline 15. In the regenerator 13, the air from pipeline 14 burns off the coke on the catalyst to restore its activity, and then the catalyst is recycled to the bottom of the first reaction zone 9 via pipeline 16 for reaction. The separated first reaction product is passed to a fractionation device 18 through pipeline 17, light hydrocarbon components obtained in the fractionation device 18 are passed to a $C_4$ separation device 38 through pipeline 19 to obtain a dry gas withdrawn through pipeline 37, propylene withdrawn through pipeline 39, other components of liquefied gas withdrawn through pipeline 40 and a fraction comprising $C_4$ olefin withdrawn through pipeline 41; $C_{5+}$ gasoline obtained from the fractionation device 18 is output from the device through pipeline 20 after being blended, the fraction comprising $C_4$ olefin obtained by fractionation is optionally mixed through pipeline 41 with external $C_4$ olefin from pipeline 42 and fed to an oligomerization device 44 through pipeline 43 for olefin oligomerization. The resulting oligomerization product is passed to a rectifying column 54 through pipeline 65 for separation, the fraction comprising $C_{12}$ olefin obtained by separation is recycled to the first reaction zone 9 of the first catalytic conversion reaction device I or a second catalytic conversion reaction device II through pipeline 57 and pipeline 45. Unconverted $C_4$ olefin is recycled to the oligomerization reactor 44 through pipeline 55, and reaction products $C_8$ olefin and $C_{16}$ olefin are output from the device or optionally recycled to the first reaction zone 9 of the first catalytic conversion reaction device I or the second catalytic conversion reaction device II through pipeline 56 and pipeline 58, respectively.

A third type of embodiments is described hereinbelow with reference to FIG. 3.

Figure 3:
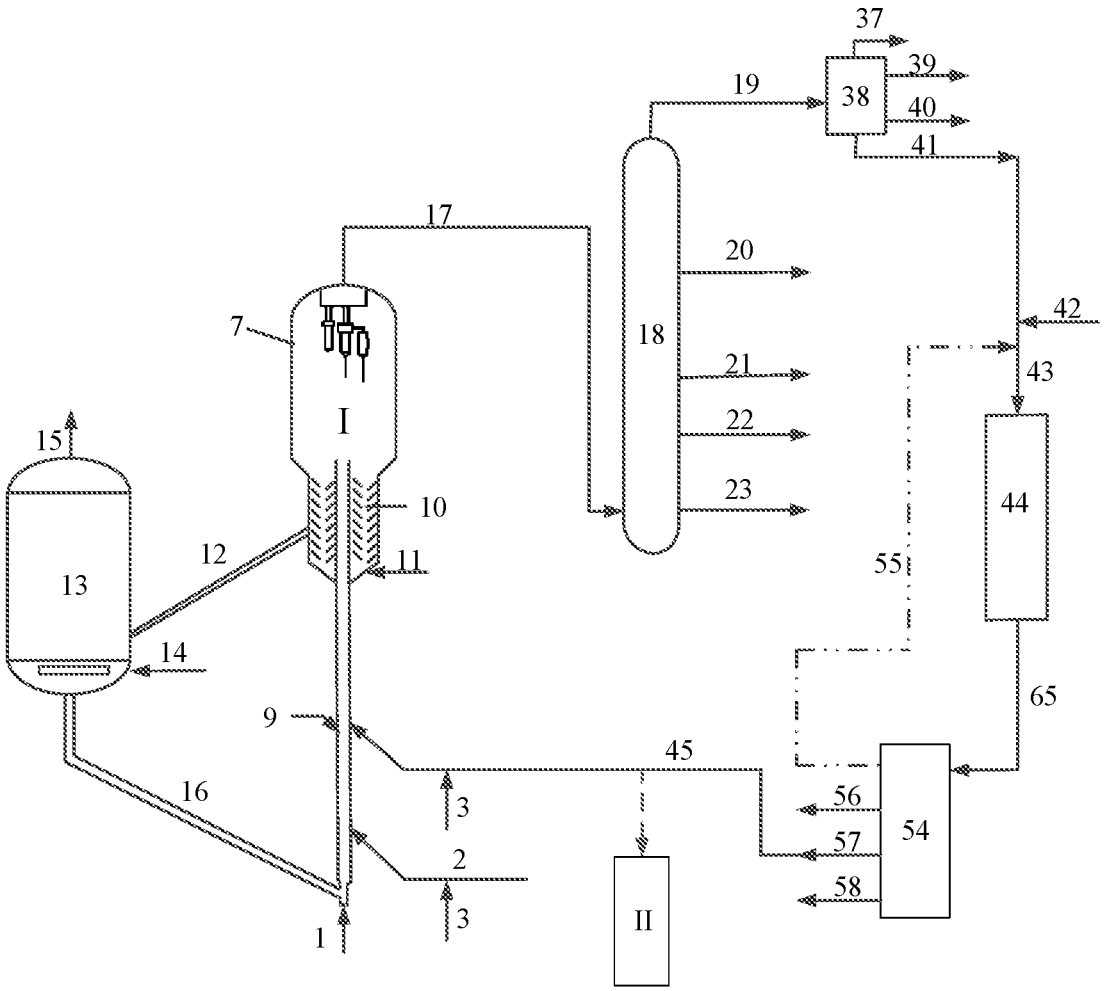
FIG. 3 is a schematic diagram of a third embodiment of the process and system of the present application.

In FIG. 3, a preheated feedstock oil from pipeline 2 and an atomizing steam from pipeline 3 are mixed and fed into a first catalytic conversion reaction device I, which is an equal-diameter riser reactor, to contact with a regenerated catalyst from pipeline 16, and is pre-lifted by a pre-lifting steam from pipeline 1. The resulting oil gas and the catalyst are conveyed upwards, and optionally reacted with a fraction comprising $C_{12}$ olefin from pipeline 45 atomized by an atomizing steam from pipeline 3. The resulting oil gas and the catalyst are conveyed upwards, and the resulting first reaction product and the first spent catalyst are subjected to oil gas and catalyst separation in a disengager 7, the separated spent catalyst deposited with carbon is subjected to stripping by steam from pipeline 11 in a stripping section 10 to stripped off the oil gas carried, and then passed to a regenerator 13 through pipeline 12 for coke burning. The resulting flue gas is discharged from the regenerator through pipeline 15. In the regenerator 13, the air from pipeline 14 burns off the coke on the catalyst to restore its activity and then the catalyst is recycled to the bottom of the first catalytic conversion reaction device I via pipeline 16 for reaction. The separated first reaction product is passed to a fractionation device 18 through pipeline 17, light hydrocarbon components obtained in the fractionation device 18 are passed to a $C_4$ separation device 38 through pipeline 19 to obtain a dry gas withdrawn through pipeline 37, propylene withdrawn through pipeline 39, other components of liquefied gas withdrawn through pipeline 40 and a fraction comprising $C_4$ olefin withdrawn through pipeline 41; $C_{5+}$ gasoline obtained from the fractionation device 18 is output from the device through pipeline 20 after being blended, the fraction comprising $C_4$ olefin obtained by fractionation is optionally mixed through pipeline 41 with external $C_4$ olefin from pipeline 42 and fed to an oligomerization device 44 through pipeline 43 for olefin oligomerization. The resulting oligomerization product is passed to a rectifying column 54 through pipeline 65 for separation, the fraction comprising $C_{12}$ olefin obtained by separation is recycled to the first catalytic conversion reaction device I or a second catalytic conversion reaction device II through pipeline 57 and pipeline 45. Unconverted $C_4$ olefin is recycled to the oligomerization reactor 44 through pipeline 55, and reaction products $C_8$ olefin and $C_{16}$ olefin are output from the device or optionally recycled to the first catalytic conversion reaction device I or the second catalytic conversion reaction device II through pipeline 56 and pipeline 58, respectively.

A fourth type of embodiments is described hereinbelow with reference to FIG. 4.

Figure 4:
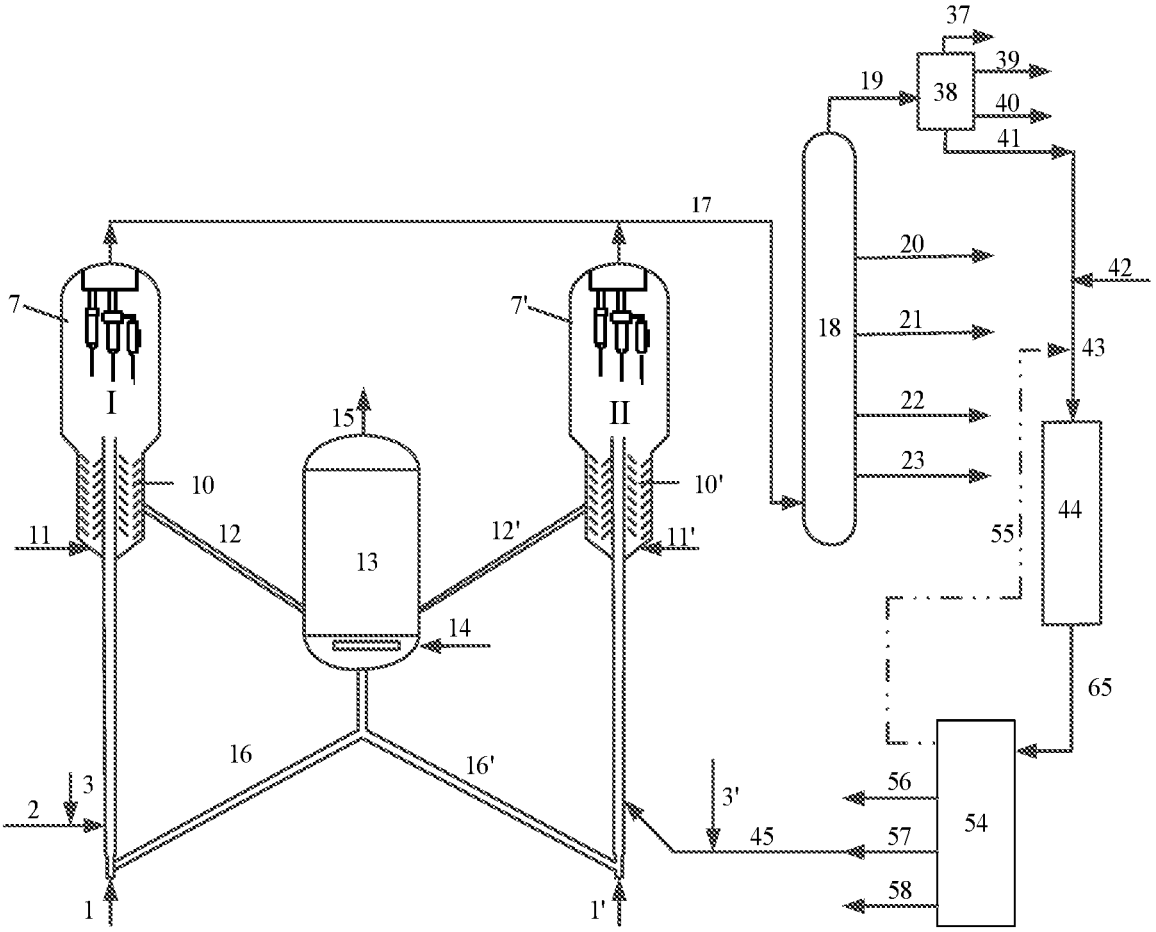
FIG. 4 is a schematic diagram of a fourth embodiment of the process and system of the present application.

In FIG. 4, a preheated feedstock oil from pipeline 2 and an atomizing steam from pipeline 3 are mixed and fed to a first catalytic conversion reaction device I, the resulting first reaction product and first spent catalyst are subjected to oil gas and catalyst separation in a disengager 7, the separated spent catalyst deposited with carbon is subjected to stripping by steam through pipeline 11 in a stripping section 10 to stripped off the oil-gas carried, and then the catalyst is passed to a regenerator 13 through pipeline 12 for coke burning. The resulting flue gas is discharged from the regenerator through pipeline 15. In the regenerator 13, the air from pipeline 14 burns off the coke on the catalyst to restore its activity, and then the catalyst is recycled to the bottom of the first catalytic conversion reaction device I via pipeline 16 for reaction. The separated first reaction product is passed to a fractionation device 18 through pipeline 17, light hydrocarbon components obtained in the fractionation device 18 are passed to a $C_4$ separation device 38 through pipeline 19 to obtain a dry gas withdrawn through pipeline 37, propylene withdrawn through pipeline 39, other components of liquefied gas withdrawn through pipeline 40 and a fraction comprising $C_4$ olefin withdrawn through pipeline 41; $C_{5+}$ gasoline obtained from the fractionation device 18 is output from the device through pipeline after being blended, the fraction comprising $C_4$ olefin obtained by fractionation is optionally mixed through pipeline 41 with external $C_4$ olefin from pipeline 42, and fed to an oligomerization device 44 through pipeline 43 for olefin oligomerization. The resulting oligomerization product is passed to a rectifying column 54 through pipeline 65 for separation. Unconverted $C_4$ olefin is recycled to the oligomerization reactor 44 through pipeline 55, reaction products $C_8$ olefin and $C_{16}$ olefin are output from the device or optionally recycled to the first catalytic conversion reaction device I or a second catalytic conversion reaction device II through pipeline 56 and pipeline 58, respectively. The fraction comprising $C_{12}$ olefin obtained by separation is sent to the second catalytic conversion reaction device II through pipeline 57 and pipeline 45 to contact with a regenerated catalyst from pipeline 16' pre-lifted by a pre-lifting steam from pipeline 1' for reaction. The resulting second reaction product and second spent catalyst are subjected to oil gas and catalyst separation in a disengager 7', the separated spent catalyst deposited with carbon is subjected to stripping by steam from pipeline 11' in a stripping section 10' to strip off the oil gas carried, and then the catalyst is passed to a regenerator 13 through pipeline 12' for coke burning. The resulting flue gas is discharged from the regenerator through pipeline 15. In the regenerator 13, the air from pipeline 14 burns off the coke on the catalyst to restore its activity, and then the catalyst is recycled to the second catalytic conversion reaction device II via pipeline 16' for reaction. The separated second reaction product is mixed via pipeline 17 with the first reaction product and passed to fractionation device 18.

In preferred embodiments, the present application provides the following technical solutions:

1. A process for producing gasoline and propylene, comprising:

feeding $C_4$ olefin to an oligomerization reactor to contact with an oligomerization catalyst for oligomerization to obtain an oligomerization product comprising $C_{12}$ olefin;

feeding a feedstock oil to a first catalytic conversion reaction device to contact with a catalytic conversion catalyst for a first catalytic conversion reaction to obtain a first reaction product and a first spent catalyst;

regenerating the first spent catalyst, and recycling the resulting regenerated catalyst to the first catalytic conversion reaction device;

separating from the first reaction product at least a fraction comprising $C_4$ olefin and a FGO, preferably recycling the fraction comprising $C_4$ olefin to the oligomerization reactor to contact with the oligomerization catalyst for oligomerization to obtain an oligomerization product comprising $C_{12}$ olefin;

separating $C_{12}$ olefin from the resulting oligomerization product comprising $C_{12}$ olefin, recycling at least part of the $C_{12}$ olefin obtained to the first catalytic conversion reaction device and/or sending it to a second catalytic conversion reaction device; contacting the $C_{12}$ olefin with a second catalytic conversion catalyst in the second catalytic conversion reaction device for a second catalytic conversion reaction to obtain a second reaction product and a second spent catalyst; regenerating the second spent catalyst, and recycling the resulting regenerated catalyst to the second catalytic conversion reaction device; optionally separating the resulting second reaction product together with the first reaction product;

optionally, feeding the resulting FGO to a first hydrotreating reactor to contact with a first hydrotreating catalyst for a first hydrotreatment to obtain a hydrogenated FGO; preferably, feeding at least a part of the hydrogenated FGO to the first catalytic conversion reaction device and/or to the second catalytic conversion reaction device.

2. The process according to Item 1, wherein the oligomerization conditions include: a temperature of 50-500° C., a pressure of 0.5-5.0 MPa, and a weight hourly space velocity of 0.1-100 $h^{-1}$;

the oligomerization catalyst is one or more selected from the group consisting of phosphoric acid catalysts, acidic resins, silica-alumina solid acid catalysts and zeolite solid acid catalysts;

wherein the phosphoric acid catalyst is one or more selected from a catalyst formed by loading phosphoric acid on diatomite, a catalyst formed by loading phosphoric acid on activated carbon, a catalyst formed from phosphoric acid-soaked quartz sand, a catalyst formed by loading phosphoric acid on silica gel and a catalyst formed by loading copper pyrophosphate on silica gel;

the silica-alumina solid acid catalyst is a catalyst formed by loading metal ion(s) on alumina and/or amorphous silica-alumina carrier, wherein the loaded metal ion(s) are selected from Group VIII metals and/or Group IVA metals;

the zeolite solid acid catalyst comprises, based on the weight of the catalyst, 10-100 wt % of a zeolite and 0-90 wt % of a matrix, wherein the zeolite is one or more selected from the group consisting of Y zeolites, ZSM-5 zeolites and beta zeolites.

3. The process according to Item 1, wherein the sources of $C_4$ olefin include, but are not limited to: the catalytic conversion reaction device, other catalytic conversion reaction device(s), and other units that produce a product comprising $C_4$ olefin;

the oligomerization product has a $C_{12}$ olefin content of no less than 20 wt %, based on the weight of the oligomerization product;

the $C_4$ olefin-containing fraction has a $C_4$ olefin content of 40-100 wt %;

the fraction comprising $C_4$ olefin has a sulfur content of not greater than 20 μg/g, a basic nitride content of not greater than 0.6 μg/g, a water content of 600-1800 μg/g, and a diene content of not greater than 200 μg/g, based on the weight of the fraction comprising $C_4$ olefin;

the $C_{12}$ olefin recycled to the first catalytic conversion reaction device and/or fed to the second catalytic conversion reaction device accounts for 0.1-80 wt %, preferably 1-70 wt %, of the weight of the feedstock oil, the light cycle oil fraction has a distillation range of 190-265° C., preferably 200-260° C.; and the FGO fraction has a distillation range of >250° C., preferably >260° C.

4. The process according to Item 1, further comprising: contacting the feedstock oil with a second hydrotreating catalyst in a second hydrotreating reactor for a second hydrotreatment, and then sending the resulting hydrogenation product to the first catalytic conversion reaction device;

the property of the feedstock oil satisfies at least one of the following criteria:

a density of 900-1000 kg/m$^3$, preferably 930-960 kg/m$^3$, a carbon residue of 4-15 wt %, preferably 6-12 wt %, a metal content of 15-600 ppm, preferably 15-100 ppm, an acid value of 0.5-20 mg KOH/g, preferably 0.5-10 mg KOH/g;

the conditions of the second hydrotreatment include: a hydrogen partial pressure of 3.0-20.0 MPa, a reaction temperature of 300-450° C., a hydrogen-to-oil volume ratio of 100-2000 standard cubic meters/cubic meter, and a volume space velocity of 0.1-3.0 h$^{-1}$;

the second hydrotreating catalyst comprises a carrier and an active metal, wherein the carrier is one or more selected from the group consisting of alumina, silica and amorphous silica-alumina, and the active metal is selected from Group VIB metals and/or Group VIII metals, preferably, the carrier comprises about 2-15 wt % of Al and 5-30 wt % of P, based on the weight of the carrier, and the catalyst comprises 5-40 wt % of Group VIB metal oxides and 1-12 wt % of Group VIII metal oxides, based on the weight of the catalyst.

5. The process according to Item 1, wherein the conditions of the first hydrotreatment include: a hydrogen partial pressure of 3.0-20.0 MPa, a reaction temperature of 300-450° C., a volume space velocity of 0.1-10.0 h$^{-1}$, and a hydrogen-to-oil volume ratio of 100-1500 standard cubic meters/cubic meter; the first hydrotreating catalyst comprises a carrier and an active metal, wherein the carrier is one or more selected from the group consisting of alumina, silica and amorphous silica-alumina, and the active metal is selected from Group VIB metals and/or Group VIII metals.

6. The process according to Item 1, further comprising: separating from the first reaction product a FGO fraction having a distillation range >260° C. and a light cycle oil fraction having a distillation range of 200-260° C., sending the FGO fraction to a first hydrotreating reactor for the first hydrotreatment, then recycling it to the first catalytic conversion reaction device and/or the second catalytic conversion reaction device, and sending the light cycle oil fraction to the first catalytic conversion reaction device and/or the second catalytic conversion reaction device.

7. The process according to Item 1, wherein the first catalytic conversion reaction device and the second catalytic conversion reaction device are each independently selected from the group consisting of an equal-diameter riser, a constant-linear-velocity riser, a diameter-transformed riser, a fluidized bed, a combined reactor comprising an equal-diameter riser in combination with a fluidized bed, an upward conveyor line, and a downer conveyor line, or a combination of two of them connected in series.

8. The process according to Item 7, wherein the diameter-transformed riser comprises a first reaction zone and a second reaction zone along the flow direction of the reaction stream; the second reaction zone is provided with one or more chilling/heating medium inlets at the bottom, and/or the second reaction zone is provided with a heat remover, and the height of the heat remover is 50-90% of the height of the second reaction zone.

9. The process according to Item 1, wherein the first catalytic conversion catalyst and the second catalytic conversion catalyst are each independently an amorphous silica-alumina catalyst and/or a zeolite catalyst, wherein the zeolite in the zeolite catalyst is one or more selected from the group consisting of Y zeolite, HY zeolite, ultrastable Y zeolite, ZSM-5 series zeolite, high-silica zeolite having a pentasil structure, and ferrierite.

10. The process according to Item 1, further comprising: separating the first reaction product and/or the second reaction product to obtain a slurry oil, and recycling at least a part of the slurry oil to the first catalytic conversion reaction device and/or the second catalytic conversion reaction device.

11. The process according to Item 1, wherein the feedstock oil comprises a petroleum hydrocarbon and/or other mineral oil, wherein the petroleum hydrocarbon is one or more selected from the group consisting of atmospheric gas oil, vacuum gas oil, atmospheric residue, vacuum residue, hydrogenated residue, coker gas oil, and deasphalted oil; said other mineral oil is one or more selected from the group consisting of coal and natural gas derived liquid oil, oil sand oil, tight oil and shale oil.

12. The process according to Item 1, wherein at least one of the feedstock oil, the hydrogenated FGO and the $C_{12}$ olefin is fed into the first catalytic conversion reaction device at the same feed point and/or at two or more feed points.

13. The process according to Item 7, wherein the first catalytic conversion reaction device is a diameter-transformed riser, the first catalytic conversion reaction device comprises a first reaction zone and a second reaction zone along the flow direction of the reaction stream, and the feedstock oil, the hydrogenated FGO and the $C_{12}$ olefin are fed into the first reaction zone;

the conditions of the first catalytic conversion reaction include:

the first reaction zone: a reaction temperature of 450-620° C., preferably 500-600° C., a reaction time of 0.5-2.0 seconds, preferably 0.8-1.5 seconds, a catalyst-to-feedstock weight ratio of 3-15:1, preferably 4-12:1, and a steam-to-feedstock weight ratio of 0.03-0.3:1, preferably 0.05-0.15:1;

the second reaction zone: a reaction temperature of 460-550° C., preferably 480-530° C., a reaction time of 2-30 seconds, preferably 3-15 seconds, a catalyst-to-feedstock weight ratio of 4-18:1, preferably 4.5-15:1, and a steam-to-feedstock weight ratio of 0.03-0.3:1, preferably 0.05-0.15:1.

14. The process according to Item 1, wherein the conditions of the second catalytic conversion reaction include: a reaction temperature of 450-620° C., a reaction time of 0.5-20.0 seconds, a catalyst-to-oil weight ratio of 1-25, and a steam-to-oil weight ratio of 0.03-0.3.

15. A system for producing gasoline and propylene, comprising a first catalytic conversion reaction device, a regenerator, an oil-catalyst separation device, a product separation device, an oligomerization reactor, a rectifying column and an optional second catalytic conversion reaction device;

the first catalytic conversion reaction device is provided with a catalyst inlet, a feedstock inlet and an oil-catalyst outlet, the regenerator is provided with a catalyst inlet and a catalyst outlet, the oil-catalyst separation device is provided with an oil-catalyst inlet, an oil-gas outlet and a catalyst outlet, the product separation device is provided with at least an oil-gas inlet and a $C_4$ olefin-containing fraction outlet, the oligomerization reactor is provided with a feedstock inlet and an oligomerization product outlet, the rectifying column is provided with an oil-gas inlet, a $C_{12}$ olefin outlet and a separated product outlet, and the second catalytic conversion reaction device is provided with a catalyst inlet, a feedstock inlet and an oil-catalyst outlet;

the catalyst inlet of the first catalytic conversion reaction device is in fluid communication with the catalyst outlet of the regenerator, the oil-catalyst outlet of the first catalytic conversion reaction device is in fluid communication with the oil-catalyst inlet of the oil-catalyst separation device, the catalyst outlet of the oil-catalyst separation device is in fluid communication with the catalyst inlet of the regenerator, the oil-gas outlet of the oil-catalyst separation device is in fluid communication with the oil-gas inlet of the product separation device, the $C_4$ olefin-containing fraction outlet of the product separation device is in fluid communication with the feedstock inlet of the oligomerization reactor, the oligomerization product outlet of the oligomerization reactor is in fluid communication with the oil-gas inlet of the rectifying column, and the $C_{12}$ olefin outlet of the rectifying column is in fluid communication with the feedstock inlet of the first catalytic conversion reaction device and optionally in fluid communication with the feedstock inlet of the second catalytic conversion reaction device;

preferably, the system further comprises a first hydrotreating reactor, the product separation device is further provided with a FGO outlet, the feedstock inlet of the first hydrotreating reactor is in fluid communication with the FGO outlet of the product separation device, and the product outlet of the first hydrotreating reactor is in fluid communication with the feedstock inlet of the first catalytic conversion reaction device, and optionally in fluid communication with the feedstock inlet of the second catalytic conversion reaction device.

16. The system according to Item 15, further comprising a second hydrotreating reactor, the second hydrotreating reactor is provided with a feedstock oil inlet and a product outlet, the product outlet of the second hydrotreating reactor is in fluid communication with the feedstock inlet of the first catalytic conversion reaction device;

the product separation device is further provided with a light cycle oil outlet, and the light cycle oil outlet of the product separation device is in fluid communication with the feedstock inlet of the first catalytic conversion reaction device.

EXAMPLES

The present application will be further illustrated with reference to the following examples, but is not limited thereto.

Properties of the feedstock oils A to C used in the examples and comparative examples of the present application are shown in Table 1.

TABLE 1

Properties of feedstock oils used in the examples and comparative examples

| Properties of the feedstock | A | B | C |
|---|---|---|---|
| Density (20° C.)/(kg/m$^3$) | 902 | 859.7 | 890.5 |
| Conradson carbon residue, wt % | 4.67 | 0.07 | 2.94 |
| C, wt % | 83.8 | 85.63 | 86.48 |
| H, wt % | 12.7 | 13.45 | 13.18 |
| S, wt % | 0.16 | 0.077 | 0.15 |
| N, wt % | 0.2109 | 0.058 | 0.19 |
| Fe, μg/g | 7.57 | 2.3 | 9.1 |

TABLE 1-continued

Properties of feedstock oils used in the examples and comparative examples

| Properties of the feedstock | A | B | C |
|---|---|---|---|
| Na, μg/g | — | 0.6 | 0.16 |
| Ni, μg/g | 5.04 | 4.9 | 5.4 |
| V, μg/g | 0.96 | 0.4 | 16.49 |
| Initial boiling point, ° C. | 221 | 316 | 261 |
| 10%, ° C. | 332 | 357 | 439 |
| 30%, (C.) | — | 390 | 501 |
| 50%, ° C. | 354 | 419 | 550 |

The preparation of the catalytic conversion catalyst A used in the examples is briefly described as follows:

1) 20 kg of $NH_4Cl$ was dissolved in 1000 kg of water, 100 kg (on a dry basis) of ZRP-1 zeolite as a crystallization product (available from Qilu Branch of Sinopec Catalyst Co., Ltd., $SiO_2/Al_2O_3$=100, rare earth content $RE_2O_3$=2.0 wt %) was added to the solution, exchanged at 90° C. for 0.5 hours, and filtered to obtain a filter cake; 4.0 g of $H_3PO_4$ (with a concentration of 85%) and 4.5 g of $Fe(NO_3)_3$ were added and dissolved in 90 g of water, and then mixed with the filter cake for impregnation, and dried; then calcined at 550° C. for 2 hours to obtain a mesoporous zeolite with MFI structure containing phosphorus and iron, of which the chemical composition determined by elemental analysis is as follows:

$0.1Na_2O \cdot 5.1Al_2O_3 \cdot 2.4P_2O_5 \cdot 1.5Fe_2O_3 \cdot 3.8RE_2O_3 \cdot 88.1SiO_2$;

2) 75.4 kg of halloysite (an industrial product available from Suzhou China Clay Company, with a solid content of 71.6 wt %) was slurried with 250 kg of decationized water, then 54.8 kg of pseudo-boehmite (an industrial product available from Shandong Aluminum Plant, with a solid content of 63 wt %) was added, and the resultant was adjusted to a pH of 2-4 with hydrochloric acid, stirred uniformly, and allowed to stand for aging at 60-70° C. for 1 hour, kept at the pH of 2-4, and cooled to a temperature below 60° C., and then 41.5 kg of alumina sol (available from Qilu Branch of Sinopec Catalyst Co., Ltd., with an $Al_2O_3$ content of 21.7 wt %) was added, and stirred for 40 minutes to obtain a mixed slurry;

3) the phosphorus and iron-containing mesoporous zeolite with MFI structure (dry weight of 24.5 kg) obtained in step 1) and ultrastable Y zeolite DASY (1.3 kg on a dry basis, available from Qilu Branch of Sinopec Catalyst Co., Ltd.) were added into the mixed slurry obtained in step 2), stirred uniformly, spray dried, washed with ammonium dihydrogen phosphate solution (with a phosphorus content of 1 wt %) to remove free $Na^+$, and dried to obtain a catalytic conversion catalyst designated as Catalyst A. The catalyst comprises, on a dry basis, 20 wt % of the phosphorus and iron-containing mesoporous zeolite with MFI structure, 1 wt % of macroporous zeolite DASY, 32 wt % of pseudo-boehmite, 7 wt % of alumina sol and a balance of kaolin.

The preparation of the hydrotreating catalyst used in the examples is briefly described as follows:

ammonium metatungstate ($(NH_4)_2W_4O_{13} \cdot 18H_2O$, chemically pure) and nickel nitrate ($Ni(NO_3)_2 \cdot 18H_2O$, chemically pure) were weighed and formulated into 200 ml of solution with water. The solution was added to 50 g of alumina carrier, immersed at room temperature for 3 hours, the immersion liquid was treated with ultrasonic waves for 30 minutes during the immersion, cooled, filtered, and dried in a microwave oven for about 15 minutes to obtain a catalyst, designated as Catalyst F. The catalyst has the following composition: 30.0 wt % $WO_3$, 3.1 wt % NiO and a balance of alumina.

The properties of catalytic conversion catalysts A, B, C, D and oligomerization catalyst E used in the examples are listed in Table 2. The oligomerization catalyst E is a zeolite solid acid catalyst available from Qilu Branch of Sinopec Catalyst Co., Ltd. under the trade name RGW-1; Catalyst B is a catalytic cracking catalyst available from Qilu Branch of Sinopec Catalyst Co., Ltd. under the trade name MMC-1; Catalyst C is a catalyst with high propylene and gasoline yield available from Qilu Branch of Sinopec Catalyst Co., Ltd. under the trade name RAG-1; and Catalyst D is a conventional catalytic cracking catalyst available from Qilu Branch of Sinopec Catalyst Co., Ltd. under the trade name MLC-500.

TABLE 2

Properties of the catalysts used in the examples

| Catalyst name | A | B | C | D | E |
|---|---|---|---|---|---|
| Zeolite type | Meso-porous + macro-porous (very little) | Meso-porour (main) + macro-porous (minor) | Meso-porous (minor) + macro-porous (main) | Macro-porous | / |
| Aluminum oxide | 50.1 | 51 | 50.2 | 38.4 | 49.8 |
| Sodium oxide | 0.066 | 0.066 | 0.321 | 0.34 | 0.28 |
| Iron oxide | 0.3 | 0.056 | 1.1 | / | / |
| Rare earth | / | / | | 2.5 | / |
| Apparent density, $kg/m^3$ | 750 | 800 | 700 | 740 | 745 |
| Pore volume, ml/g | 0.25 | 0.22 | 0.40 | 0.28 | 0.67 |
| Specific surface area, $m^2/g$ | 251 | 191 | 196 | 234 | 258 |
| Abrasion index, wt %/h | 1.09 | 2.8 | 1.5 | 1.7 | 1.1 |
| Sieving composition, wt % | | | | | |
| 0-40 microns | 17.9 | 27.8 | 20.2 | / | / |
| 40-80 microns | 47.9 | 62 | 50.1 | / | / |
| >80 microns | 34.2 | 10.2 | 29.7 | / | / |

Example 1

This example was conducted in accordance with the process flow shown in FIG. 1, using Feedstock oil A directly as a feedstock for catalytic conversion, on a pilot plant of diameter-transformed riser reactor. Feedstock oil A was fed to the bottom of a first reaction zone 9, contacted with Catalyst A at the bottom of the first reaction zone 9 and subjected to catalytic conversion reaction sequentially in the first reaction zone 9 and a second reaction zone 8. The resulting reaction product and spent catalyst deposited with carbon were separated in a disengager, and the reaction product was split according to distillation range in a product separation device to obtain dry gas, ethylene, propylene, propane and a fraction comprising $C_4$ olefin (with a $C_4$ olefin content of 85.9 wt %), butane, gasoline, a light cycle oil fraction having a distillation range of 200-260° C., and a FGO fraction having a distillation range of >260° C.

The fraction comprising $C_4$ olefin was fed to an oligomerization reactor for oligomerization, and the fraction comprising $C_{12}$ olefin (with a $C_{12}$ olefin content of 85.2 wt %) separated by a rectifying column was recycled to the second reaction zone 8; the light cycle oil fraction having a distillation range of 200-260° C. was recycled to the first reaction zone 9 for reuse, the FGO fraction having a distillation range >260° C. was subjected to a hydrotreatment under conditions including a hydrogen partial pressure of 18.0 MPa, a reaction temperature of 350° C., a hydrogen-to-oil volume ratio of 1500 and a volume space velocity of 1.5 $h^{-1}$, and the hydrogenation product was recycled to the first reaction zone 9 for catalytic conversion reaction. The $C_{12}$ olefin introduced in the second reaction zone 8 accounted for 18.9 wt % of the total catalytic conversion feedstock. The operating conditions and product distribution are listed in Table 3.

Comparative Example 1-a

The operation was substantially the same as in Example 1, except that a conventional catalytic cracking catalyst D was used and the product was split as required in the conventional catalytic cracking process to obtain dry gas, liquefied gas, propylene, gasoline, diesel oil and slurry oil, and no recycle of the catalytic conversion product was carried out. The operating conditions and product distribution are listed in Table 3.

Comparative Example 1-b

The operation was substantially the same as in Example 1, except that the separated $C_4$ olefin-containing fraction (with a $C_4$ olefin content of 85.7%) was fed to the oligomerization reactor for oligomerization, and the $C_8$ olefin-containing fraction (with a $C_8$ olefin content of 84.9 wt %) separated by the rectifying column was recycled to the second reaction zone, and the $C_8$ olefin accounted for 18.8 wt % of the total catalytic conversion feedstock. The operating conditions and product distribution are listed in Table 3.

TABLE 3

Operating conditions and results of Example 1, Comparative Examples 1-a and 1-b

| Item | Example 1 | | Comparative Example 1-a | Comparative Example 1 b |
|---|---|---|---|---|
| Feedstock oil | Feedstock oil A | Feedstock oil A* | Feedstock oil A | Feedstock oil A |
| Operating conditions (catalytic conversion reaction device) | | | | |
| Reactor | Dual-diameter riser | Dual-diameter riser | Dual-diameter riser | Dual-diameter riser |
| Catalyst | A | A | D | A |
| Riser outlet temperature, ° C. | 500 | 500 | 500 | 500 |
| Temperature of reaction zone I/II, ° C. | 550/500 | 550/500 | 550/500 | 550/500 |
| Reaction time of reaction zone I/II, second | 1.0/4.7 | 1.0/4.7 | 1.0/4.7 | 1.0/4.7 |
| Catalyst-to-oil weight ratio of reaction zone I/II | 5.0/6.5 | 5.0/6.5 | 5.0/6.5 | 5.0/6.5 |
| Steam/feedstock oil weight ratio | 0.10 | 0.10 | 0.10 | 0.10 |
| Operating conditions (oligomerization reactor) | | | | |
| Catalyst | E | / | / | E |
| Temperature of $C_4$ olefin oligomerization, ° C. | 200 | / | / | 120 |
| Pressure of $C_4$ | 2 | / | / | 1 |

TABLE 3-continued

| | | | | |
|---|---|---|---|---|
| olefin oligomerization, MPa | | | | |
| Weight hourly space velocity of $C_4$ olefin oligomerization, $h^{-1}$ | 1 | / | / | 1 |
| Operating conditions (hydrotreating reactor) | | | | |
| Catalyst | F | / | / | F |
| Temperature, ° C. | 350 | / | / | 350 |
| Hydrogen partial pressure, MPa | 18.0 | / | / | 18.0 |
| Volume space velocity, $h^{-1}$ | 1.5 | / | / | 1.5 |
| Hydrogen-to-oil volume ratio | 1500 | / | / | 1500 |
| Product distribution, wt % | | | | |
| Dry gas | 3.62 | 3.30 | 3.01 | 3.54 |
| Methane | 0.43 | 0.40 | 0.51 | 0.51 |
| Ethane | 0.33 | 0.31 | 0.38 | 0.38 |
| Liquefied gas | 35.25 | 28.09 | 17.51 | 33.94 |
| Propylene | 25.68 | 12.11 | 5.1 | 22.67 |
| Propylene/propane | / | 3.9 | 3.0 | / |
| Isobutene/isobutane | / | 1.8 | 0.7 | / |
| Gasoline | 51.51 | 37.39 | 48.81 | 52.93 |
| Diesel oil | — | 18.90 | 18.92 | — |
| Slurry oil | — | 3.64 | 3.00 | — |
| Coke | 9.62 | 8.68 | 8.75 | 9.59 |
| Total | 100.00 | 100.00 | 100.00 | 100.00 |

*Data of Example 1 in column 2 are operating conditions and results for the case where the catalytic conversion reaction was carried out only in the diameter-transformed riser reactor and the resulting catalytic conversion product was not recycled.

Example 2

The test was conducted using Feedstock oil B as the feedstock for catalytic conversion, on a composite reactor as shown in FIG. 2 comprising a riser and a dense phase bed connected in series. The Feedstock oil B was contacted with Catalyst B, reacted in the riser unit under conditions including a reaction temperature of 650° C., a reaction time of 0.8 second, a catalyst-to-oil weight ratio of 20, and a steam-to-oil weight ratio of 0.8; the resulting reaction stream was passed to the dense phase bed unit for further reaction at a reaction temperature of 580° C. and a weight hourly space velocity of 10 $h^{-1}$ to obtain a spent catalyst and a reaction product. The spent catalyst was regenerated, and the regenerated catalyst was recycled to the riser unit as the catalytic conversion catalyst. The reaction product was split according to distillation range in a product separation device to obtain dry gas, ethylene, propylene, propane, a fraction comprising $C_4$ olefin (with a $C_4$ olefin content of 84.8 wt %), butane, gasoline, diesel oil and slurry oil.

The fraction comprising $C_4$ olefin was fed to an oligomerization reactor for oligomerization, and the fraction comprising $C_{12}$ olefin (with a $C_{12}$ olefin content of 85.1 wt %) separated by a rectifying column was recycled to the dense phase bed unit. The $C_{12}$ olefin introduced into the dense phase bed unit for further cracking accounted for 15.5 wt % of the total catalytic conversion feedstock. The operating conditions and product distribution are listed in Table 4.

Comparative Example 2

The operation was substantially the same as in Example 2, except that the catalytic conversion product was separated and split to obtain dry gas, liquefied gas, propylene, gasoline, diesel oil and slurry oil, and the recycling of the catalytic conversion product was not performed. The operating conditions and product distribution are listed in Table 4.

TABLE 4

Operating conditions and results of Example 2 and Comparative Example 2

| Item | Example 2 | Comparative Example 2 |
|---|---|---|
| Feedstock oil | B | B |
| Operating conditions (catalytic conversion reaction device) | | |
| Reactor | Riser + dense phase bed | Riser + dense phase bed |
| Riser unit | | |
| Catalyst | B | B |
| Reaction temperature, ° C. | 650 | 650 |
| Reaction time, second | 0.8 | 0.8 |
| Steam/feedstock oil weight ratio | 0.8 | 0.8 |
| Catalyst/feedstock oil weight ratio | 20.0 | 20.0 |
| Dense phase bed unit | | |
| Reaction temperature, ° C. | 580 | 580 |
| Weight hourly space velocity, $h^{-1}$ | 10 | 10 |
| Operating conditions (oligomerization reactor) | | |
| Catalyst | E | / |
| Temperature of $C_4$ olefin oligomerization, ° C. | 200 | / |
| Pressure of $C_4$ olefin oligomerization, MPa | 2 | / |
| Weight hourly space velocity of $C_4$ olefin oligomerization, $h^{-1}$ | 1 | / |
| Product distribution, wt % | | |
| Dry gas | 12.51 | 11.91 |
| Methane | 3.32 | 3.24 |
| Ethane | 2.34 | 2.33 |
| Liquefied gas | 40.43 | 42.22 |
| Propylene | 25.65 | 19.30 |
| Propylene/propane | / | 6.34 |
| Isobutene/isobutane | / | 2.03 |
| Gasoline | 27.31 | 26.60 |
| BTX | 7.61 | 7.53 |
| Diesel oil | 6.83 | 6.69 |
| Slurry oil | 6.39 | 6.37 |
| Coke | 6.53 | 6.21 |
| Total | 100.00 | 100.00 |

Example 3

The test was conducted in accordance with the process flow shown in FIG. 3 using Feedstock oil C as a starting material for catalytic conversion on an equal-diameter riser reactor. Feedstock oil C was contacted with Catalyst C, and reacted in the riser reactor under conditions including a reaction temperature of 530° C., a reaction time of 3.5 seconds, a catalyst-to-oil weight ratio of 8, and a steam-to-oil weight ratio of 0.1 to obtain a spent catalyst and a reaction product. The spent catalyst was regenerated, and the regenerated catalyst was recycled to the riser reactor as the catalytic conversion catalyst. The reaction product was split according to distillation range in a product separation device to obtain dry gas, ethylene, propylene, propane, a fraction comprising $C_4$ olefin (with a $C_4$ olefin content of 85.0 wt %), butane, gasoline, diesel oil and slurry oil.

The fraction comprising $C_4$ olefin was fed to an oligomerization reactor for oligomerization, and the fraction comprising $C_{12}$ olefin (with a $C_{12}$ olefin content of 85.3 wt %) separated by a rectifying column was recycled to the riser reactor. The $C_{12}$ olefin recycled to the riser reactor for further cracking accounted for 14.17 wt % of the total catalytic conversion feedstock. The operating conditions and product distribution are listed in Table 5.

Comparative Example 3

The operation was substantially the same as in Example 3, except that the catalytic conversion product was split according to distillation range in the product separation device to obtain dry gas, liquefied gas, propylene, gasoline, diesel oil and slurry oil, and the recycling of the catalytic conversion product was not performed. The operating conditions and product distribution are listed in Table 5.

TABLE 5

Operating conditions and results of Example 3 and Comparative Example 3

| Item | Example 3 | Comparative Example 3 |
|---|---|---|
| Feedstock oil | C | C |
| Operating conditions (catalytic conversion reaction device) | | |
| Reactor | Riser reactor | Riser reactor |
| Catalyst | C | C |
| Reaction temperature, ° C. | 530 | 530 |
| Reaction time, second | 3.5 | 3.5 |
| Steam/feedstock oil weight ratio | 0.1 | 0.1 |
| Catalyst/feedstock oil weight ratio | 8 | 8 |
| Operating conditions (oligomerization reactor) | | |
| Catalyst | E | / |
| Temperature of $C_4$ olefin oligomerization, ° C. | 200 | / |
| Pressure of $C_4$ olefin oligomerization, MPa | 2 | / |
| Weight hourly space velocity of $C_4$ olefin oligomerization, $h^{-1}$ | 1 | / |
| Product distribution, wt % | | |
| Dry gas | 3.75 | 3.72 |
| Methane | 0.89 | 0.87 |
| Ethane | 0.68 | 0.66 |
| Liquefied gas | 22.75 | 23.10 |
| Propylene | 13.85 | 8.56 |
| Propylene/propane | / | 5.3 |
| Isobutene/isobutane | / | 1.0 |
| Gasoline | 43.70 | 43.51 |
| Diesel oil | 19.55 | 19.49 |
| Slurry oil | 3.53 | 3.51 |
| Coke | 6.72 | 6.67 |
| Total | 100.00 | 100.00 |

Example 4

The test was conducted using Feedstock oil C as a feedstock for catalytic conversion on a system of double riser reactors as shown in FIG. 4. Feedstock oil C was contacted with Catalyst C, and reacted in a first riser reactor at a reaction temperature of 530° C., a reaction time of 3.5 seconds, a catalyst-oil weight ratio of 8 and a steam-to-oil weight ratio of 0.10 to obtain a spent catalyst and a reaction product. The spent catalyst was regenerated, and the regenerated catalyst was recycled to the first riser reactor as the catalytic conversion catalyst. The resulting reaction product was split according to distillation range in a product separation device to obtain dry gas, ethylene, propylene, propane, butane, a fraction comprising $C_4$ olefin (with a $C_4$ olefin content of 85.3 wt %), gasoline, diesel oil and slurry oil.

The fraction comprising $C_4$ olefin was fed to an oligomerization reactor 44 for oligomerization in accordance with the process flow shown in FIG. 4, a fraction comprising $C_{12}$ olefin (with a $C_{12}$ olefin content of 85.0 wt %) was separated by a rectifying column, and the fraction comprising $C_{12}$ olefin was fed to the bottom of the second riser reactor for reaction. The $C_{12}$ olefin introduced into the second riser reactor accounted for 15.9 wt % of the total catalytic conversion feedstock, and the reaction was conducted at a reaction temperature of 530° C., a reaction time of 2.0 seconds, a catalyst-to-oil weight ratio of 8, and a steam-to-oil weight ratio of 0.10. The operating conditions and the product distribution of the final product obtained by combining the reaction products of the first riser reactor and the second riser reactor are listed in Table 6.

TABLE 6

Operating conditions and results of Example 4

| Item | Example 4 |
|---|---|
| Feedstock oil | C |
| Operating conditions (catalytic conversion reaction device) | |
| Reactor | Double risers connected in parallel |
| Catalyst | C |
| Outlet temperature of the first/second riser, ° C. | 530/530 |
| Reaction time of the first/second riser, second | 3.5/2.0 |
| Weight ratio of catalyst/feedstock oil | 8 |
| Weight ratio of steam/feedstock oil | 0.10 |
| Operating conditions (oligomerization reactor) | |
| Catalyst | E |
| Temperature of $C_4$ olefin oligomerization, ° C. | 200 |
| Pressure of $C_4$ olefin oligomerization, MPa | 2 |
| Weight hourly space velocity of $C_4$ olefin oligomerization, $h^{-1}$ | 1 |
| Final product distribution, wt % | |
| Dry gas | 3.83 |
| Liquefied gas | 21.46 |
| Propylene | 15.76 |
| Gasoline | 43.50 |
| Diesel oil | 20.31 |
| Slurry oil | 3.82 |
| Coke | 7.08 |
| Total | 100.00 |

As can be seen from a comparison of the results of the above examples and comparative examples, the process and system of the present application provides a higher propylene yield by oligomerizing $C_4$ olefin to $C_{12}$ olefin and recycling the resulting $C_{12}$ olefin. In addition, the results in Table 3 also show that the catalytic conversion reaction of Example 1 can provide a lower alkane yield and a higher propylene yield by itself, as compared to Comparative Example 1, and the propylene yield can be further greatly increased by the oligomerization of $C_4$ olefin and the recycle of $C_{12}$ olefin.

The present application is illustrated in detail hereinabove with reference to preferred embodiments, but is not intended to be limited to those embodiments. Various modifications may be made following the inventive concept of the present application, and these modifications shall be within the scope of the present application.

It should be noted that the various technical features described in the above embodiments may be combined in any suitable manner without contradiction, and in order to avoid unnecessary repetition, various possible combinations are not described in the present application, but such combinations shall also be within the scope of the present application.

In addition, the various embodiments of the present application can be arbitrarily combined as long as the combination does not depart from the spirit of the present application, and such combined embodiments should be considered as the disclosure of the present application.

The invention claimed is:

1. A process for producing gasoline and propylene, comprising the steps of:

1) Subjecting a feedstock oil to a first catalytic conversion reaction in a first catalytic conversion reaction device to obtain a first reaction product comprising propylene, $C_4$ olefin and a gasoline component;

2) Separating the first reaction product to obtain a propylene fraction, a gasoline fraction, a first $C_4$ olefin-containing fraction having 40-100 wt % $C_4$ olefin, optionally a light cycle oil fraction and optionally a fluidized catalytic cracking gas oil (FGO) fraction;

3) Subjecting the first $C_4$ olefin-containing fraction obtained in step 2) or a combination of the first $C_4$ olefin-containing fraction obtained in step 2) and a $C_4$ olefin-containing fraction from an external source to olefin oligomerization in an oligomerization reactor to obtain an oligomerization product comprising $C_{12}$ olefin, separating the oligomerization product to obtain a second $C_4$ olefin-containing fraction, a $C_8$ olefin-containing fraction, and a $C_{12}$ olefin-containing fraction, wherein the $C_{12}$ olefin-containing fraction has a $C_{12}$ olefin content of no less than 70 wt %, based on the weight of the $C_{12}$ olefin-containing fraction;

4) Sending the $C_{12}$ olefin-containing fraction to the first catalytic conversion reaction device, and/or sending the $C_{12}$ olefin-containing fraction to a second catalytic conversion reaction device for a second catalytic conversion reaction to obtain a second reaction product comprising propylene; and 5) Optionally, subjecting the FGO fraction to a first hydrotreatment in a first hydrotreating reactor to obtain a hydrogenated FGO, and recycling at least a part of the hydrogenated FGO to the first catalytic conversion reaction device and/or sending it to the second catalytic conversion reaction device, and/or recycling the light cycle oil fraction to the first catalytic conversion reaction device and/or sending it to the second catalytic conversion reaction device, wherein the first catalytic conversion reaction device is a diameter-transformed riser reactor comprising a first reaction zone and a second reaction zone having a diameter greater than the first reaction zone along the direction of the reaction stream, wherein the second catalytic conversion reaction device, when present, is a fluidized bed reactor that is a riser reactor or a composite reactor comprising a riser in combination with a dense phase bed, wherein the riser reactor is an equal-diameter riser reactor, a constant-linear-velocity riser reactor or a diameter-transformed riser reactor, wherein the reaction conditions in the first reaction zone include a reaction temperature of about 450-620° C., a reaction time of about 0.5-2.0 seconds, a catalyst-to-feedstock weight ratio of about 3:1 to about 15:1, a steam-to-feedstock weight ratio of about 0.03:1 to about 0.3:1, wherein the reaction conditions in the second reaction zone include a reaction temperature of about 460-550° C., a reaction time of about 2-30 seconds, a catalyst-to-feedstock weight ratio of about 4:1 to about 18:1, and a steam-to-feedstock weight ratio of about 0.03:1 to about 0.3:1, and wherein:

the second $C_4$ olefin-containing fraction is sent to the oligomerization reactor, the $C_8$ olefin-containing fraction is sent to the first reaction zone in the diameter-transformed riser reactor, and the $C_{12}$ olefin-containing fraction is sent to the second reaction zone of the diameter-transformed riser reactor.

2. The process according to claim 1, wherein the olefin oligomerization of step 3) is carried out in the presence of an oligomerization catalyst under conditions including:

a temperature of about 50-500° C., a pressure of about 0.5-5.0 MPa, and a weight hourly space velocity of about 0.1-100 $h^{-1}$;

the oligomerization catalyst is one or more selected from the group consisting of phosphoric acid catalysts, acidic resins, silica-alumina solid acid catalysts, and zeolite solid acid catalysts;

wherein, the phosphoric acid catalyst is one or more selected from the group consisting of a catalyst formed by loading phosphoric acid on diatomite, a catalyst formed by loading phosphoric acid on activated carbon, a catalyst formed from phosphoric acid-soaked quartz sand, a catalyst formed by loading phosphoric acid on silica gel, and a catalyst formed by loading copper pyrophosphate on silica gel;

the silica-alumina solid acid catalyst is a catalyst formed by loading metal ion(s) on alumina and/or amorphous silica-alumina carrier, wherein the loaded metal ion(s) is selected from the group consisting of Group VIII metals, Group IVA metals, and a combination thereof; and the zeolite solid acid catalyst comprises about 10-100 wt % of a zeolite and about 0-90 wt % of a matrix, based on the weight of the zeolite solid acid catalyst, wherein the zeolite is one or more selected from the group consisting of one-dimensional zeolites selected from MTW (ZSM-12), MTT (ZSM-23), and TON (ZSM-22) zeolites, two-dimensional zeolites selected from FER (ferrierite), MFS (ZSM-57), MWW (MCM-22) and MOR (mordenite) zeolites, and three-dimensional zeolites selected from beta zeolites.

3. The process according to claim 1, wherein:

the optional light cycle oil fraction in step 2) has a distillation range of about 190-350° C.; the optional FGO fraction is a heavy fraction obtained at the bottom of the catalytic conversion fractionator; and the $C_{12}$ olefin recycled to the first catalytic conversion reaction device and/or to the second catalytic conversion reaction device in step 4) accounts for about 0.1-80 wt %, of the total catalytic conversion feedstock.

4. The process according to claim 1, further comprising:

subjecting the feedstock oil to a second hydrotreatment in a second hydrotreating reactor prior to step 1);

the second hydrotreatment is carried out in the presence of a second hydrotreating catalyst under conditions including:

a hydrogen partial pressure of about 3.0-20.0 MPa, a reaction temperature of about 300-450° C., a hydrogen-to-oil volume ratio of about 100-2000 standard cubic meter/cubic meter, and a volume space velocity of about 0.1-3.0 $h^{-1}$;

the second hydrotreating catalyst comprises about 70-99 wt % of a carrier, which is one or more selected from the group consisting of alumina, silica and amorphous silica-alumina, and about 0.1-30 wt % of an active metal (calculated as oxide) selected from the group consisting of Group VIB metals, Group VIII metals, and a combination thereof.

5. The process according to claim 1, wherein the first hydrotreatment is conducted in the presence of a first hydrotreating catalyst under conditions including:

a hydrogen partial pressure of about 3.0-20.0 MPa, a reaction temperature of about 300-450° C., a volume space velocity of about 0.1-10.0$h^{-1}$, and a hydrogen-to-oil volume ratio of about 100-1500 standard cubic meters/cubic meter;

the first hydrotreating catalyst comprises about 60-99 wt % of a carrier, which is one or more selected from the group consisting of alumina, silica and amorphous silica-alumina, and about 5-40 wt % of an active metal (calculated as oxide) selected from the group consisting of Group VIB metals, Group VIII metals, and a combination thereof.

6. The process according to claim 1, wherein the catalyst for the first catalytic conversion reaction and the catalyst for the second catalytic conversion reaction, if present, are each independently selected from the group consisting of amorphous silica-alumina catalysts, zeolite catalysts, and a combination thereof, and wherein the zeolite in the zeolite catalyst is one or more selected from the group consisting of Y zeolite, HY zeolite, ultrastable Y zeolite, ZSM-5 series zeolite, high-silica zeolite having a pentasil structure, and ferrierite.

7. The process according to claim 1, wherein the feedstock oil is selected from the group consisting of petroleum hydrocarbons, mineral oils, and a combination thereof, wherein the petroleum hydrocarbon is one or more selected from the group consisting of atmospheric gas oil, vacuum gas oil, atmospheric residue, vacuum residue, hydrogenated residue, coker gas oil, and deasphalted oil; and the mineral oil is one or more selected from the group consisting of coal and natural gas derived liquid oil, oil sand oil, tight oil, and shale oil.

8. The process according to claim 1, wherein the first catalytic conversion reaction is carried out to the extent that a gaseous product having the following characteristics is obtained:

a mass fraction ratio of liquefied gas to dry gas of not less than about 7;

a methane yield of no greater than about 2.0%;

a mass fraction ratio of propylene to propane in the liquefied gas of not less than about 3.5; and/or a mass fraction ratio of isobutylene to isobutane of not less than about 1.5.

9. The process according to claim 1, wherein said $C_{12}$ olefin-containing fraction is sent to the second catalytic conversion reaction device in step 4), and the second catalytic conversion reaction is carried out under conditions including: a reaction temperature of about 450-620° C., a reaction time of about 0.5-20.0 seconds, a catalyst-to-oil weight ratio of about 1-25, and a steam-to-oil weight ratio of about 0.03-0.3.

10. A process for producing gasoline and propylene, comprising the steps of:

1) Subjecting a feedstock oil to a first catalytic conversion reaction in a first catalytic conversion reaction device to obtain a first reaction product comprising propylene, $C_4$ olefin and a gasoline component;

2) separating the first reaction product to obtain a propylene fraction, a gasoline fraction, a first $C_4$ olefin-containing fraction having 40-100 wt % $C_4$ olefin, optionally a light cycle oil fraction and optionally a fluidized catalytic cracking gas oil (FGO) fraction;

3) Subjecting the first $C_4$ olefin-containing fraction obtained in step 2) or a combination of the first $C_4$ olefin-containing fraction obtained in step 2) and a $C_4$ olefin-containing fraction from an external source to olefin oligomerization in an oligomerization reactor to obtain an oligomerization product comprising $C_{12}$ olefin, and separating the oligomerization product to obtain a $C_{12}$ olefin-containing fraction, wherein the $C_{12}$ olefin-containing fraction has a $C_{12}$ olefin content of no less than 70 wt %, based on the weight of the $C_{12}$ olefin-containing fraction;

4) Sending the $C_{12}$ olefin-containing fraction to the first catalytic conversion reaction device, and/or sending the $C_{12}$ olefin-containing fraction to a second catalytic conversion reaction device for a second catalytic conversion reaction to obtain a second reaction product comprising propylene; and 5) optionally, subjecting the FGO fraction to a first hydrotreatment in a first hydrotreating reactor to obtain a hydrogenated FGO, and recycling at least a part of the hydrogenated FGO to the first catalytic conversion reaction device and/or sending it to the second catalytic conversion reaction device, and/or recycling the light cycle oil fraction to the first catalytic conversion reaction device and/or sending it to the second catalytic conversion reaction device, wherein the second catalytic conversion reaction device, when present, is a fluidized bed reactor that is a riser reactor or a composite reactor comprising a riser in combination with a dense phase bed, wherein the riser reactor is an equal-diameter riser reactor, a constant-linear-velocity riser reactor or a diameter-transformed riser reactor, and wherein the first catalytic conversion reaction device is a diameter-transformed riser reactor comprising a first reaction zone and a second reaction zone having a diameter greater than the first reaction zone along the direction of the reaction stream, wherein the reaction conditions in the first reaction zone include:

a reaction temperature of about 450-620° C., a reaction time of about 0.5-2.0 seconds, and a catalyst-to-feedstock weight ratio of about 3:1 to about 15:1, a steam-to-feedstock weight ratio of about 0.03:1 to about 0.3:1, and the reaction conditions in the second reaction zone include:

a reaction temperature of about 460-550° C., a reaction time of about 2-30 seconds, a catalyst-to-feedstock weight ratio of about 4:1 to about 18:1, and a steam-to-feedstock weight ratio of about 0.03:1 to about 0.3:1, and wherein, in step 4), the $C_{12}$ olefin-containing fraction is recycled to the second reaction zone of the first catalytic conversion reaction device that is a diameter-transformed riser reactor in step 4), at least a part of the hydrogenated FGO is recycled to the first reaction zone of the diameter-transformed riser reactor in step 5), and/or the light cycle oil fraction is recycled to the first reaction zone of the diameter-transformed riser reactor in step 5).

11. A system for producing gasoline and propylene, comprising a first catalytic conversion reaction device, a regenerator, an oil-catalyst separation device, a product separation device, an oligomerization reactor, a rectifying column and optionally a second catalytic conversion reaction device, wherein:

the first catalytic conversion reaction device is configured to perform a first catalytic conversion reaction on a feedstock oil therein to obtain a reaction effluent comprising a first reaction product and a spent catalyst, wherein the first reaction product comprises propylene, $C_4$ olefin, and a gasoline component;

the oil-catalyst separation device is configured to separate the first reaction product from the spent catalyst in the reaction effluent of the first catalytic conversion reaction device, the regenerator is configured to regenerate the spent catalyst and recycle the regenerated catalyst to the first catalytic conversion reaction device, the product separation device is configured to separate the first reaction product to obtain a propylene fraction, a gasoline fraction, a $C_4$ olefin-containing fraction comprising $C_4$ olefin, optionally a light cycle oil fraction and optionally a FGO fraction, the oligomerization reactor is configured to conduct an olefin oligomerization on the $C_4$ olefin-containing fraction to obtain an oligomerization product comprising $C_{12}$ olefin, and send the oligomerization product to the rectifying column;

the rectifying column is configured to separate the oligomerization product to obtain a $C_{12}$ olefin-containing fraction having a $C_{12}$ olefin content of no less than 70 wt %, based on the weight of the $C_{12}$ olefin-containing fraction, and recycle the $C_{12}$ olefin-containing fraction to the first catalytic conversion reaction device or to the optional second catalytic conversion reaction device;

the second catalytic conversion reaction device, when present, is configured to perform a second catalytic conversion reaction on the $C_{12}$ olefin-containing fraction to obtain a second reaction product comprising propylene, wherein the first catalytic conversion reaction device is provided with a catalyst inlet, at least one catalytic conversion feedstock inlet, and an oil-catalyst outlet, the regenerator is provided with a spent catalyst inlet and a regenerated catalyst outlet, the oil-catalyst separator is provided with an oil-catalyst inlet, an oil-gas outlet, and a spent catalyst outlet, the product separator is provided with an oil-gas inlet, a propylene fraction outlet, a gasoline fraction outlet, and a $C_4$ olefin-containing fraction outlet, the oligomerization reactor is provided with an oligomerization feedstock inlet and an oligomerization product outlet, and the rectifying column is provided with an oil-gas inlet and a $C_{12}$ olefin-containing fraction outlet;

the catalyst inlet of the first catalytic conversion reaction device is in fluid communication with the regenerated catalyst outlet of the regenerator, the oil-catalyst outlet of the first catalytic conversion reaction device is in fluid communication with the oil-catalyst inlet of the oil-catalyst separation device, the spent catalyst outlet of the oil-catalyst separation device is in fluid communication with the spent catalyst inlet of the regenerator, the oil-gas outlet of the oil-catalyst separation device is in fluid communication with the oil-gas inlet of the product separation device, the $C_4$ olefin-containing fraction outlet of the product separation device is in fluid communication with the oligomerization feedstock inlet of the oligomerization reactor, the oligomerization product outlet of the oligomerization reactor is in fluid communication with the oil-gas inlet of the rectifying column, and the $C_{12}$ olefin-containing fraction outlet of the rectifying column is in fluid communication with one catalytic conversion feedstock inlet of the first catalytic conversion reaction device or in fluid communication with the feedstock inlet of the second catalytic conversion reaction device, wherein the system further comprises a first hydrotreating reactor, wherein the product separation device is further provided with a FGO fraction outlet, the feedstock inlet of the first hydrotreating reactor is in fluid communication with the FGO fraction outlet of the product separation device, and the product outlet of the first hydrotreating reactor is in fluid communication with one catalytic conversion feedstock inlet of the first catalytic conversion reaction device or in fluid communication with the feedstock inlet of the second catalytic conversion reaction device; and the product separation device is further provided with a light cycle oil fraction outlet, and the light cycle oil fraction outlet of the product separation device is in fluid communication with one catalytic conversion feedstock inlet of the first catalytic conversion reaction device or is in fluid communication with the feedstock inlet of the second catalytic conversion reaction device.

12. The system according to claim 11, wherein the first catalytic conversion reaction device is a diameter-transformed riser reactor comprising a first reaction zone and a second reaction zone having a diameter greater than the first reaction zone along the flow direction of the reaction stream, wherein the bottom of the second reaction zone is provided with one or more chilling/heating medium inlets, and/or the second reaction zone is provided with a heat remover, and the height of the heat remover is about 50-90% of the height of the second reaction zone.

13. The system according to claim 11, further comprising a second hydrotreating reactor having a feedstock inlet and a hydrogenation product outlet, wherein the hydrogenation product outlet of the second hydrotreating reactor is in fluid communication with one catalytic conversion feedstock inlet of the first catalytic conversion reaction device.

* * * * *